US008831453B2

(12) United States Patent
Matsumoto

(10) Patent No.: US 8,831,453 B2
(45) Date of Patent: Sep. 9, 2014

(54) IMAGE FORMING APPARATUS

(75) Inventor: Jun Matsumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 262 days.

(21) Appl. No.: 13/473,897

(22) Filed: May 17, 2012

(65) Prior Publication Data

US 2012/0308249 A1 Dec. 6, 2012

(30) Foreign Application Priority Data

May 30, 2011 (JP) ..... 2011-120324

(51) Int. Cl.
*G03G 15/16* (2006.01)
*G03G 15/01* (2006.01)

(52) U.S. Cl.
CPC ..... *G03G 15/0189* (2013.01)
USPC ..... 399/66

(58) Field of Classification Search
CPC ..... G03G 15/161
USPC ..... 399/66
See application file for complete search history.

(56) References Cited

U.S. PATENT DOCUMENTS

| | | | | |
|---|---|---|---|---|
| 5,440,379 | A * | 8/1995 | Hayamizu | 399/308 |
| 7,113,713 | B2 * | 9/2006 | Soda et al. | 399/66 |
| 2011/0044710 | A1 * | 2/2011 | Shida | 399/66 |
| 2012/0045256 | A1 * | 2/2012 | Sasaoka et al. | 399/301 |

FOREIGN PATENT DOCUMENTS

| | | | |
|---|---|---|---|
| JP | 2001-242723 | A | 9/2001 |
| JP | 2004-013035 | A | 1/2004 |
| JP | 2004-117920 | A | 4/2004 |

* cited by examiner

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

The image forming apparatus includes an image bearing member that bears a toner image, an image forming unit, an intermediate transfer unit, a primary transfer member, a cleaning member movable between a contact position and a non-contact position, a voltage application unit, a control unit, a current detection unit, wherein the control unit moves the cleaning member at the non-contact position, determines a transfer voltage based on a current value detected by said current detection unit when a predetermined voltage is applied from said voltage application unit to said primary transfer member before an image formation and in a condition where said cleaning member is at the non-contact position, and applies the transfer voltage to the primary transfer member in the image formation.

13 Claims, 12 Drawing Sheets

| FIG. 3A |
| --- |
| FIG. 3B |

| FIG. 5A |
| --- |
| FIG. 5B |

| |
|---|
| FIG. 7A-1 |
| FIG. 7A-2 |
| FIG. 7A-3 |

IMAGE FORMING APPARATUS

BACKGROUND OF THE INVENTION

1. Field of the Invention

The present invention mainly relates to an image forming apparatus, such as a color laser printer, a color copy machine and a color facsimile, adopting an electrophotographic process.

2. Description of the Related Art

In an image forming apparatus adopting an electrophotographic process, a toner as a developer develops a latent image, and the latent image is transferred and fixed on a recording material such as print paper to form an image. To particularly form a color image in the image forming apparatus, toner images of a plurality of colors (yellow, magenta, cyan and black) are primarily transferred and superposed on an intermediate transfer unit, and then the toner images are secondarily transferred all together to the recording material in a generally known configuration. An example of a known method of collecting a residual toner remained on the intermediate transfer unit after the transfer of the color image to the recording material includes a method of collecting the residual toner from the intermediate transfer unit after electrical charge by a cleaning charge roller. A high voltage needs to be applied to applied members for the primary transfer, the secondary transfer and the charge of the residual toner, and a dedicated power circuit and a current detection circuit that detects a current value may be arranged for each applied member. In this case, the power circuit and the current detection circuit are independently arranged for each applied member, and there is a problem of an increase in the cost due to an increase in the number of components. Another problem in an increasingly downsized image forming apparatus is an increase in a mounted area of the circuits associated with the increase in the number of components.

In a system proposed by Japanese Patent Application Laid-Open No. 2001-242723, a plurality of transfer units as applied members share a current detection unit to reduce the number of detection circuits.

However, further downsizing of the image forming apparatus is demanded. A further reduction in the power circuits and the current detection circuits as well as a reduction in the circuit mounted area are demanded. The effect of the sharing of the current detection circuit by the plurality of transfer units proposed in Japanese Patent Application Laid-Open No. 2001-242723 is limited in a rotary-system image forming apparatus that includes only one transfer unit.

SUMMARY OF THE INVENTION

The present invention has been made under the circumstances, and an object of the present invention is to enable reducing the number of power circuits and current detection circuits and reducing a circuit mounted area.

Another object of the present invention is to provide an image forming apparatus including an image bearing member that bears a toner image; an image forming unit that forms a toner image on the image bearing member; an intermediate transfer unit that is movable; a primary transfer member that primarily transfers the toner image to the intermediate transfer unit; a cleaning member that cleans toner remaining on the intermediate transfer unit, the cleaning member being movable between a contact position in which said cleaning member contacts said intermediate transfer unit and a non-contact position in which said cleaning member does not contact said intermediate transfer unit, a voltage application unit that applies a voltage to the primary transfer member and the cleaning member, a control unit, a current detection unit that detects a current flowing through the voltage application unit, wherein the control unit moves the cleaning member at the non-contact position, determines a transfer voltage based on a current value detected by said current detection unit when a predetermined voltage is applied from said voltage application unit to said primary transfer member before an image formation and in a condition where said cleaning member is at the non-contact position, and applies the transfer voltage to the primary transfer member in the image formation.

Another object of the present invention is to provide an image forming apparatus including an image bearing member that bears a toner image, an image forming unit that forms a toner image on the image bearing member, an intermediate transfer unit to which the toner image is primarily transferred from the image bearing member, a secondary transfer member that secondarily transfers the toner image from the intermediate transfer unit to a recording material, said secondary transfer member being movable between a contact position in which said secondary transfer member contacts said intermediate transfer unit and a non-contact position in which said secondary transfer member does not contact said intermediate transfer unit, a cleaning member that cleans a toner remaining on said intermediate transfer unit, said cleaning member being movable between a contact position in which said cleaning member contacts said intermediate transfer unit and a non-contact position in which said cleaning member does not contact said intermediate transfer unit, a voltage application unit that applies a voltage to the secondary transfer member and the cleaning member, a current detection unit that detects a current flowing through the voltage application unit, and a control unit, wherein the control unit applies a secondary transfer voltage from said voltage application unit when an image is secondarily transferred, wherein the secondary transfer voltage is determined based on a first current value detected by said current detection unit when a predetermined voltage is applied from said voltage application unit in a condition where said secondary transfer member is at a contact position and said cleaning member is at the non-contact position.

A further object of the present invention will become apparent from the following description and the accompany drawings.

DESCRIPTION OF THE EMBODIMENTS

Preferred embodiments of the present invention will now be described in detail in accordance with the accompanying drawings.

Exemplary embodiments of the present invention will now be illustratively described in detail with reference to the drawings. However, dimensions, materials, shapes and a relative arrangement of constituent elements described in the following embodiments are to be appropriately changed according to configurations and various conditions of apparatuses adopting the present invention. Therefore, the scope of the present invention is not limited unless otherwise specifically described.

[Summary of Configuration of Image Forming Apparatus and Image Forming Operation]

Figure 1:
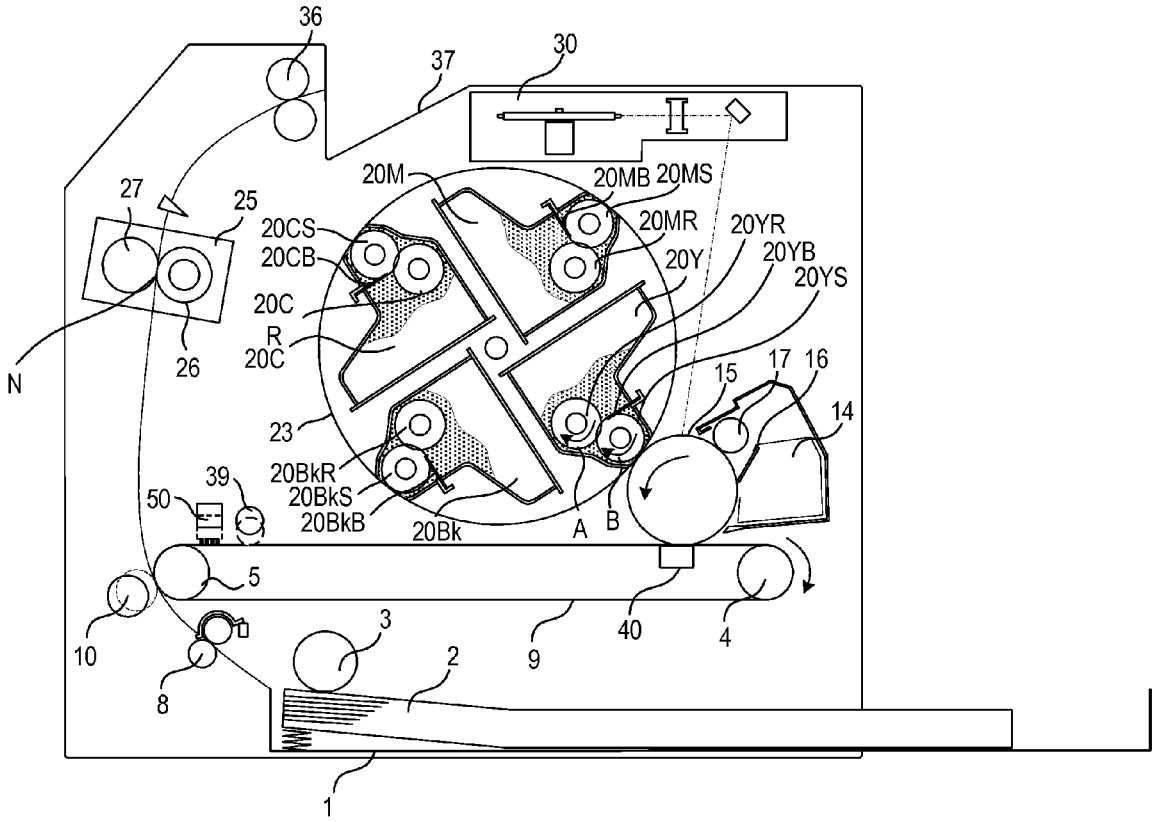
FIG. 1 is a cross-sectional diagram illustrating an overall configuration of an image forming apparatus of first to fourth embodiments.

A schematic configuration and a series of image forming operations of an image forming apparatus will be described with reference to FIG. 1. FIG. 1 is a cross-sectional diagram illustrating an overall configuration of a rotary-system color image forming apparatus that develops toner images on a photosensitive drum as an image bearing member, from developers of four colors (yellow Y, magenta M, cyan C and black Bk).

In image formation on a recording material, the image forming apparatus rotates a feed roller 3 and feeds a piece of a recording material 2 in a cassette 1. The image forming apparatus transports the recording material 2 to a registration roller 8 and waits for the formation of an image on an endless intermediate transfer belt 9 as a rotatable intermediate transfer unit. To form an image, a charge roller 17 uniformly charges the surface of a photosensitive drum 15 which is an image bearing member that forms an electrostatic latent image. A laser scanner 30 that performs laser exposure according to an image signal to form an electrostatic latent image on the photosensitive drum 15 (image bearing member) forms an electrostatic latent image of a yellow image. A charge voltage power supply 80*e* applies a voltage to the charge roller 17. A yellow developer 20Y sends a toner to an application roller 20YR based on a mechanism that transmits the toner in a container. The application roller 20YR that rotates in a direction of an arrow A and a development blade 20YB pressed against the periphery of a development roller 20YS thinly apply the toner around the development roller 20YS, which rotates in a direction of an arrow B, and provide a charge to the toner (frictional electrification). A development voltage is applied to the development roller 20YS facing the photosensitive drum 15 with the electrostatic latent image. As a result, the toner develops the electrostatic latent image formed on the photosensitive drum 15. A development/blade voltage power supply 80*f* applies a voltage to the development blade 20YB and the development roller 20YS. A voltage with a polarity opposite the toner image formed on the photosensitive drum 15 is applied to a primary transfer pad 40 (applied member) that is a primary transfer member, and the toner image of the photosensitive drum 15 is primarily transferred to the intermediate transfer belt 9. The primary transfer member pad is the primary transfer member that contacts an inner surface of the intermediate transfer belt 9 with a surface of the primary transfer member, and has a conductive layer that contacts an inner surface of the intermediate transfer belt 9 with a surface of the primary transfer member. A primary transfer roller and a primary transfer blade may be used as the primary transfer member. Configurations of a magenta developer 20M, a cyan developer 20C and a black developer 20Bk are the same as the configuration of the yellow developer 20Y, and the description will not be repeated.

When the yellow toner image is primarily transferred to the intermediate transfer belt 9, a development rotary 23 rotates, and the magenta developer 20M that forms an image rotates and moves to stop at a development position for forming an image on the photosensitive drum 15. Just like yellow, a magenta toner image is formed on the electrostatic latent image formed by charging and exposing the photosensitive drum 15. The image is primarily transferred to the intermediate transfer belt 9. The cyan developer 20C and the black developer 20Bk form and develop cyan and black electrostatic latent images and primarily transfer the images to the intermediate transfer belt 9. A color image including multiplexed and transferred four color toners of yellow, magenta, cyan and black is formed on the intermediate transfer belt 9. After the color image is formed on the intermediate transfer belt 9, the image forming apparatus transports the recording material 2, which is on standby at the registration roller 8, to a secondary transfer portion. The secondary transfer portion includes: a secondary transfer roller 10 (secondary transfer member); and a secondary transfer opposing roller 5. The secondary transfer roller 10 as a secondary transfer member is an applied member and is rotatable, and has a conductive layer and rotatable. The secondary transfer roller 10 is movable between a contact position at which the secondary transfer roller 10 contacts the intermediate transfer belt and a non-contact position that the secondary transfer roller 10 does not contact the intermediate transfer belt.

The secondary transfer opposing roller 5 is a drive roller that rotates and drives the intermediate transfer belt 9. A trailing roller 4 trails and rotates along with the movement of the intermediate transfer belt 9 and provides constant tension to the intermediate transfer belt 9. The secondary transfer roller 10 is movable with regard to the intermediate transfer belt 9, as in a state of a solid line (non-contact state) and a state of a broken line (contact state) illustrated in FIG. 1. When the color toner images are multiplexed and transferred to the intermediate transfer belt 9, the secondary transfer roller 10 is at a position (non-contact position) indicated by the solid line of FIG. 1 to prevent disordering the toner images formed on the intermediate transfer belt 9. After the transfer of the color toner images to the intermediate transfer belt 9, the secondary transfer roller 10 moves to a position indicated by the broken line of FIG. 1 according to timing of the secondary transfer of the images to the recording material 2. The secondary transfer roller 10 and the secondary transfer opposing roller 5 press the recording material 2 against the intermediate transfer belt 9. A voltage with a polarity opposite the toner is applied to the secondary transfer roller 10 to transfer the color image on the intermediate transfer belt 9 to the recording material 2.

After the transfer of the color image from the intermediate transfer belt 9 to the recording material 2, a first cleaning member (hereinafter, "ICL brush 50") (applied member) and a second cleaning member (hereinafter, "ICL roller 39") (applied member) contact the intermediate transfer belt 9. The ICL brush 50 has conductive fibers for a conductive brush and uniformly disperses the residual toner remaining on the intermediate transfer belt 9 by the conductive brush. The ICL roller 39 is a charge roller having a conductive layer and charges the residual toner dispersed by the ICL brush 50 with a polarity opposite the charge polarity of the toners during the development. The ICL brush 50 and the ICL roller 39 moves between a position shown by the solid line (non-contact position) and another position shown by the broken line (contact position) illustrated in FIG. 1. When the charge of the residual toner is finished, the ICL brush 50 and the ICL roller 39 moves at the non-contact position. When images are continuously formed, the next yellow image is formed on the photosensitive drum 15 while the ICL brush 50 and the ICL roller 39 contact the intermediate transfer belt 9 to charge the residual toner. The formed image is primarily transferred to the intermediate transfer belt 9, and the ICL brush 50 and the ICL roller 39 moves to the non-contact position when the yellow image transferred to the intermediate transfer belt 9 passes through the contact region of the ICL brush 50 and the ICL roller 39.

The primary transfer unit, in which the photosensitive drum 15 and the intermediate transfer belt 9 contact, electrostatically transfers the residual toner charged by the ICL roller 39 to the photosensitive drum 15. A cleaner blade 16 collects the residual toner to a cleaning container 14. The transfer of the residual toner to the photosensitive drum 15 and the primary transfer of the yellow toner image from the photosensitive drum 15 to the intermediate transfer belt 9 are performed at the same time.

Therefore, the first cleaning member and the second cleaning member are cleaning units that clean the intermediate transfer belt 9 as the intermediate transfer unit.

The recording material 2 is peeled off from the intermediate transfer belt 9 and transported to a fixation unit 25. The recording material 2 is fixed at a fixation nip section N between a pressure roller 27 and a fixation roller 26. The recording material 2 is ejected, with the image surface facing down, to a discharge tray 37 in an upper section of the main body through a discharge roller 36. The image forming operation is finished.

[Configurations of Voltage Power Supply and Current Detection Circuit]

Figure 2:
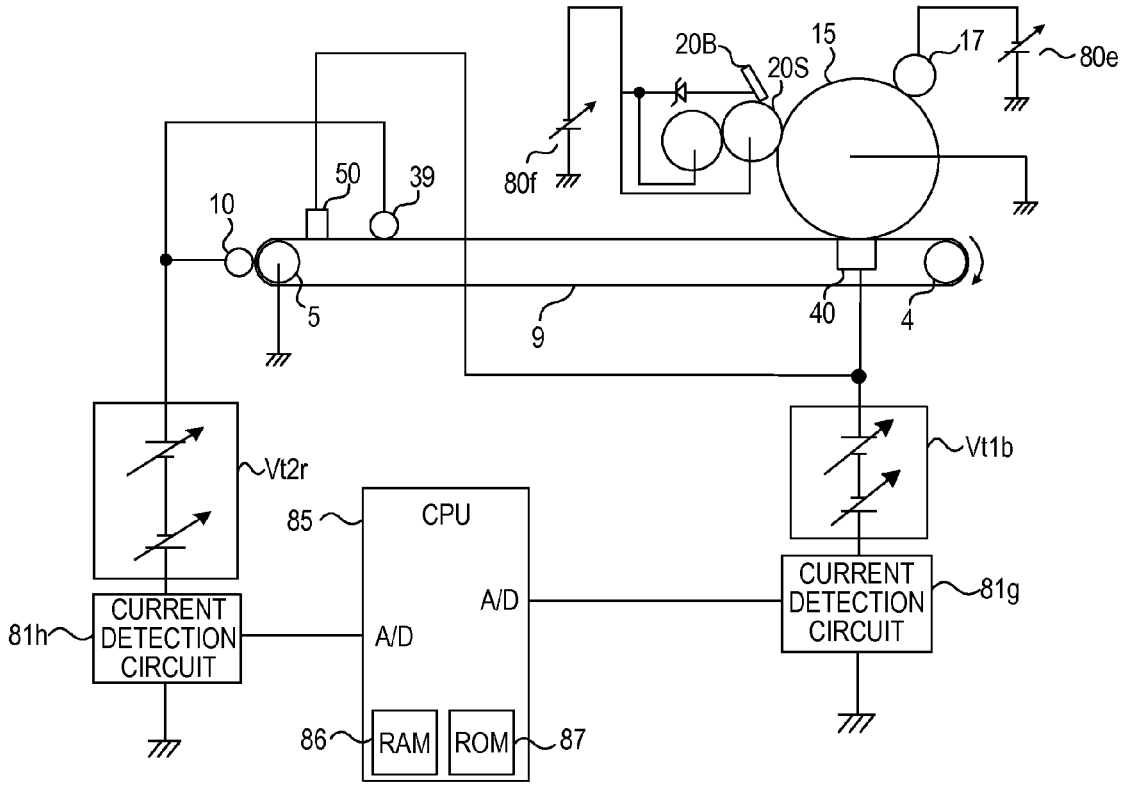
FIG. 2 is a diagram illustrating a circuit configuration of a voltage power supply and a current detection circuit of the first to fourth embodiments.

FIG. 2 is a diagram illustrating circuit configurations of a power circuit and a current detection circuit of the image forming apparatus according to the present embodiment. In FIG. 2, the power circuit and the current detection circuit applied to the primary transfer member 40 and the ICL brush 50 are shared, and the power circuit and the current detection circuit applied to the secondary transfer member 10 and the ICL roller 39 are shared. In FIG. 2, a power circuit Vt1*b* (a first common voltage application unit) is a common power circuit that supplies power to the primary transfer member 40 and the ICL brush 50. A voltage power supply Vt2*r* (a second common voltage application unit) is a common power circuit that supplies power to the secondary transfer member and the ICL roller. A current detection circuit 81*g* is a common current detection circuit (current detection unit) for primary transfer voltage and for ICL brush voltage. A current detection circuit 81*h* is a common current detection circuit (current detection unit) for secondary transfer voltage and for ICL roller voltage. A CPU 85 as a control unit is a one-chip computer that controls output voltages of the secondary transfer voltage power supplies Vt1*b* and Vt2*r* based on voltage signals from the current detection circuits 81*g* and 81*h*, environment information of the image forming apparatus and lifetime information of the intermediate transfer belt.

The CPU 85 includes a RAM 86 and a ROM 87 that are memories. The ROM 87 stores programs and various data for controlling the image forming operation of the image forming apparatus. The RAM 86 is used to compute data necessary to control the image forming operation of the image forming apparatus and is used for temporary storage. The CPU 85 also includes a timer (not illustrated) used to measure time.

In the present embodiment, the voltage power supply Vt1*b* and the current detection circuit 81*g* serve as the voltage power supply and the current detection circuit for primary transfer voltage and for ICL brush voltage. The voltage power supply Vt2*r* and the current detection circuit 81*h* serve as the voltage power supply and the current detection circuit for secondary transfer voltage and for ICL roller voltage. An electronic conductive member with small load (resistance value) variations caused by environmental variations is adopted for the ICL brush 50 and the primary transfer pad 40. Meanwhile, an ion conductive member with a little large load variations caused by environmental variations, but with small resistance fluctuations at the periphery of the roller, is adopted for the ICL roller 39 and the secondary transfer roller 10. Therefore, the voltage power supply and the current detection circuit of the components made of members with similar characteristics of load variations caused by environmental changes can be shared to supply optimal voltages.

If the power supply for the ion conductive primary transfer pad 40 and the power supply for the electronic conductive secondary transfer roller are common, setting of the voltage for the secondary transfer roller is difficult if, for example, the voltage is determined according to the ion conductive primary transfer pad, because the tendencies of the load variations are different.

[Determination Procedure of Transfer Voltage and Image Formation Control Procedure]

Figures 3, 3A:
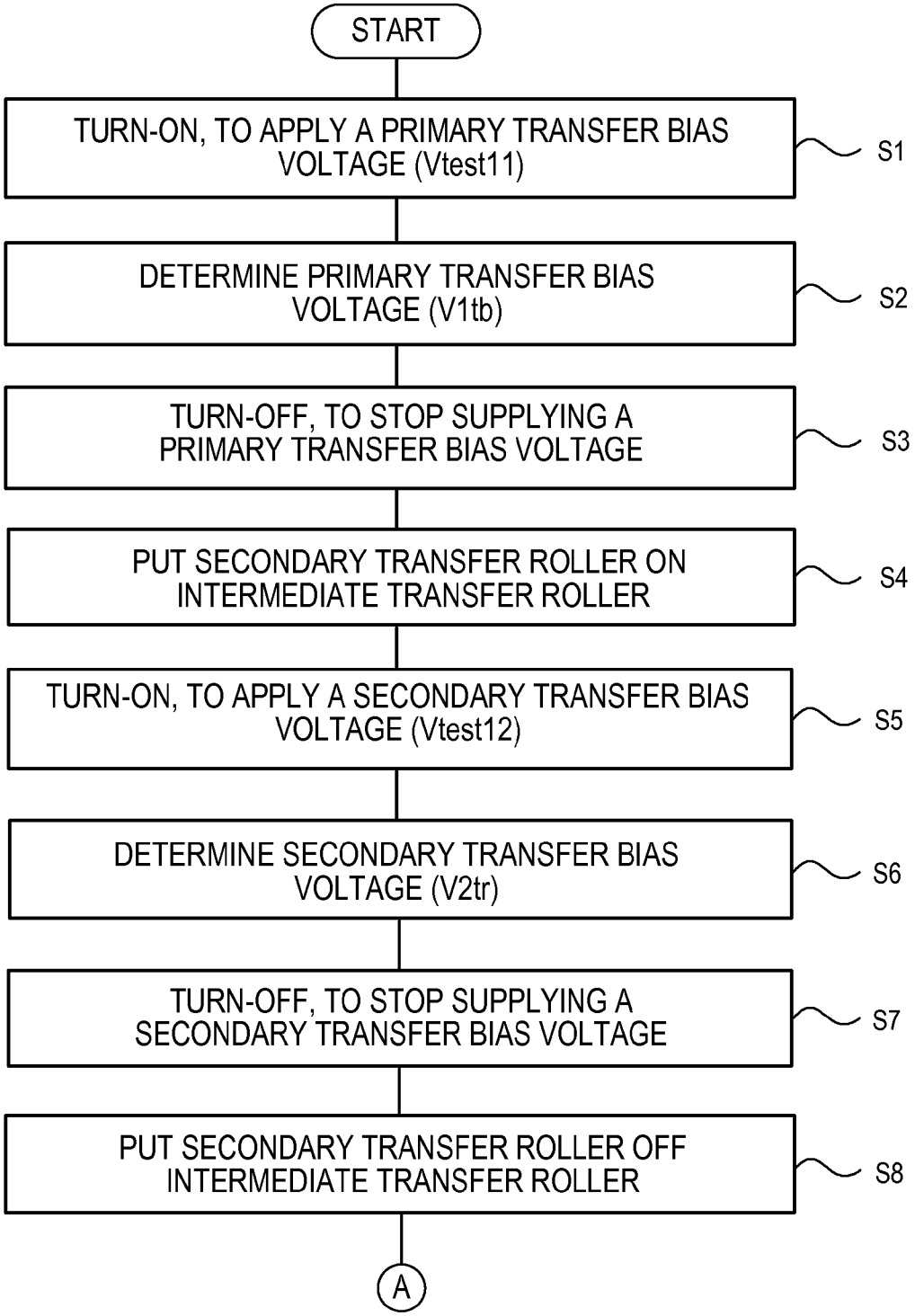
FIG. 3 which is comprised of FIGS. 3A and 3B is a flow chart illustrating a voltage value determination procedure and an image formation control procedure of the first embodiment.
Figure 3B:
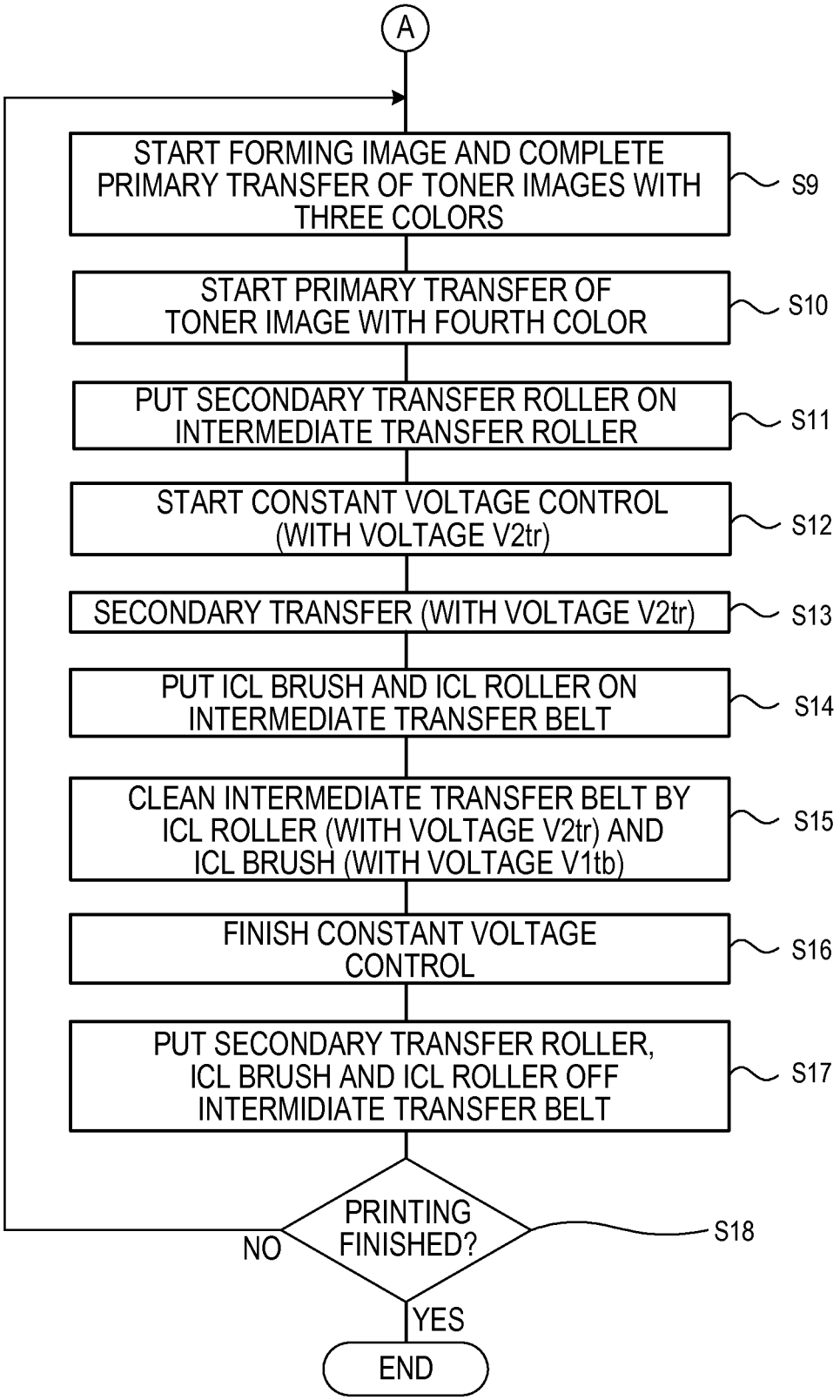

A control procedure from determination of the primary transfer voltage and the secondary transfer voltage to finish of the image forming operation will be described with reference to FIGS. 3A and 3B. FIGS. 3A and 3B show a flow chart illustrating a voltage determination procedure of the primary transfer voltage and the secondary transfer voltage and a following image formation control procedure of the present embodiment. The CPU 85 executes the procedures based on a program stored in the ROM 87.

Prior to image formation, the CPU 85 controls the voltage power supply Vt1*b* to apply a predetermined voltage Vtest11 (predetermined voltage) ("primary transfer bias" in FIGS. 3A and 3B) to the primary transfer pad 40 (step (hereinafter "S") 1). In step S1, the ICL brush 50 and the ICL roller 30 are at the non-contact position.

As a result of the application of the primary transfer voltage, a primary transfer current flows through in the order of i) the primary transfer pad 40, ii) the intermediate transfer belt 9, iii) the photosensitive drum 15 and iv) a GND. If a combined resistance value of the primary transfer pad 40, the intermediate transfer belt 9 and the photosensitive drum 15 is defined as R1*t*_11, the current detection circuit 81*g* detects a current value I1*t*_11 (=Vtest11/R1*t*_11) during primary transfer and outputs the value to the CPU 85. If a predetermined current value necessary for the primary transfer is defined as I1*t*_12, the CPU 85 calculates a primary transfer voltage V1*tb* that satisfies the current value based on a formula V1*tb*=Vtest11×I1*t*$_{_12}$/I1*t*_11 and stores the voltage in the RAM 86 (S2). The CPU 85 instructs the voltage power supply Vt1*b* to terminate outputting the voltage Vtest11 (S3).

The CPU 85 moves the secondary transfer roller 10 at the contact position (S4). After the secondary transfer roller 10 moves at the non-contact position, the CPU 85 controls the voltage power supply Vt2*r* to apply a predetermined voltage Vtest12 (predetermined voltage) to the secondary transfer roller 10 (S5). As a result of the application of the secondary transfer voltage, a secondary transfer current flows through in the order of i) the secondary transfer roller 10, ii) the intermediate transfer belt 9, iii) the secondary transfer opposing roller 5 and iv) the GND. If a combined resistance value of the secondary transfer roller 10, the intermediate transfer belt 9 and the secondary transfer opposing roller 5 is defined as R2*t*_11, the current detection circuit 81*h* detects a current value I2*t*_11 (=Vtest12/R2*t*_11) during secondary transfer and outputs the value to the CPU 85. If a predetermined current value necessary for the second transfer is defined as I2*t*_12, the CPU 85 calculates a secondary transfer voltage V2*tr* that satisfies the current value based on a formula V2*tr*=Vtest12×I2*t*_12/I2*t*_11 and stores the voltage in the RAM 86 (S6). The CPU 85 instructs the voltage power supply Vt2*r* to terminate outputting the voltage Vtest12 (S7) and moves the secondary transfer roller 10 at the non-contact position (S8).

The CPU 85 starts the image formation and completes the primary transfer of the toner images of three colors (yellow, magenta and cyan) to the intermediate transfer belt 9 (S9). When the image formation is started, the CPU 85 instructs the primary transfer voltage power supply Vt1*b* to apply the primary transfer voltage V1*tb* determined in S2 to the primary transfer pad 40 and performs constant voltage control. The primary transfer of the fourth color (black) toner image is started (S10). The CPU 85 moves the secondary transfer roller 10 on the intermediate transfer belt 9 at the contact position according to the timing when the leading edge of the toner image on the intermediate transfer belt 9 with the primarily transferred fourth color reaches the secondary transfer roller 10 (S11). For the secondary transfer voltage power supply Vt2*r*, the CPU 85 starts constant voltage control of applying the secondary transfer voltage V2*tr* calculated in S6 to the secondary transfer roller 10 (S12) and performs the secondary transfer (S13). The CPU 85 moves the ICL brush 50 and the ICL roller 39 at the contact position before the residual toner after the secondary transfer on the intermediate transfer belt 9 passes through the ICL brush 50 and the ICL roller 39 (S14). The ICL brush 50 and the ICL roller 39 clean the intermediate transfer belt 9 (S15). The CPU 85 applies the same voltage value V1*tb* as the primary transfer voltage to the ICL brush 50 and applies the same voltage value V2*tr* as the secondary transfer voltage to the ICL roller 39 (S15). When the secondary transfer from the intermediate transfer belt 9 to the recording material 2 and the cleaning of the intermediate transfer belt 9 are finished, the CPU 85 controls the primary transfer voltage power supply Vt1*b* and the secondary transfer voltage power supply Vt2*r* to terminate the application of the voltage and finishes the constant voltage control (S16). The CPU 85 moves the secondary transfer roller 10, the ICL brush 50 and the ICL roller 39 from the intermediate transfer belt 9 at the non-contact position (S17). The CPU 85 determines whether printing of the recording material 2 is completed. The CPU 85 returns to the process of S9 if the printing is not completed and finishes the image formation if the printing is completed (S18).

As described, according to the present embodiment, the voltage power circuit and the current detection circuit can be shared for the primary transfer and for the ICL brush, and the voltage power supply and the current detection circuit can be shared for the secondary transfer and for the ICL roller. As a result, the cost and the circuit mounted area can be reduced. In the present embodiment, the power circuit and the current detection circuit of the components adopting members that have the same characteristics tendencies of load (resistance value) variations caused by environmental changes can be shared to realize common circuits with reduced fluctuations in the load variations of the members. When the load fluctuations caused by environmental variations are permitted, the power supply and the current detection circuit of the primary transfer voltage and the ICL roller voltage can be shared, and the power supply and the current detection circuit of the secondary transfer voltage and the ICL brush voltage can be shared. According to the present embodiment, the number of the power circuits and the current detection circuits can be reduced, and the circuit mounted area can be reduced.

Second Embodiment

In the image forming apparatus, not only the secondary transfer roller 10 as the secondary transfer member, but also the ICL roller 39 as the cleaning member needs to move between the contact and the non-contact positions. There are three kinds of states in which: only the secondary transfer roller 10 is at the contact position; both the secondary transfer member and the cleaning member are at the contact position; and only the ICL roller 39 is at the contact position.

As a result, the current detection result by the current detection circuit is different in each state, and the constant current control is difficult when the power circuit is shared. Here, the constant current control is a control in which the power source applies a voltage into the applied material so that the current flowing in the applied material is constant. However, in the transfer and cleaning control, the current value provided to the toner can be constant (constant current control) to stably transfer the toner, and an image failure and a cleaning failure can be prevented. The present embodiment focuses on the secondary transfer that significantly affects the image quality, and optimal constant current control related to the secondary transfer roller 10 and the ICL roller 39 will be described. In the present embodiment, the constant current control optimal for the secondary transfer is performed when the secondary transfer and the cleaning are performed at the same time. The constant current control optimal for cleaning is performed when only the cleaning is performed after the completion of the secondary transfer. The following description is based on the assumption that the ICL roller 39 always at the contact position at the start of the secondary transfer.

(Calculation of Current Value for Secondary Transfer and Current Value for Cleaning)

The circuit configuration of the voltage power supply and the current detection circuit illustrated in FIG. 2 of the first embodiment are used in the present embodiment. FIGS. 4A to 4D are circuit schematic diagrams illustrating the position relationships between the secondary transfer roller and the ICL roller with regard to the intermediate transfer belt, and equivalent circuits configured according to the differences of the position relationships. A calculation procedure of a current value for secondary transfer and a current value for cleaning that are set in the constant current control will be described with reference to FIGS. 4A to 4D. The current values necessary for the secondary transfer and the cleaning are calculated before the image forming operation as in the first embodiment.

Figure 4A:
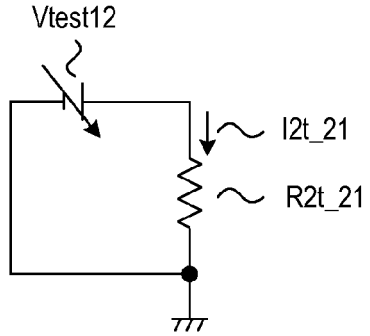
FIGS. 4A, 4B, 4C and 4D are circuit schematic diagrams illustrating the position relationship between the secondary transfer roller and the ICL roller with regard to the intermediate transfer belt, and circuits configured according to the differences of the position relationship.

FIG. 4A is a circuit schematic diagram illustrating the load status when the voltage Vtest12 is applied in the case where the ICL roller 39 is at the non-contact position and only the secondary transfer roller 10 is at the contact position. In FIG. 4A, a resistance R2*t*_21 denotes a combined resistance of the secondary transfer roller 10, the intermediate transfer belt 9 and the secondary transfer opposing roller 5 where the secondary transfer current flows through. A current I2*t*_21 denotes a current flowing through the resistance R2*t*_21. The current detection circuit 81*h* detects the current value of the current I2*t*_21 and outputs the current value to the CPU 85. The CPU 85 can calculate a resistance value of the combined resistance R2*t*_21 from a formula of the secondary transfer current I2*t*_21=Vtest12/R2*t*_21.

Figure 4B:
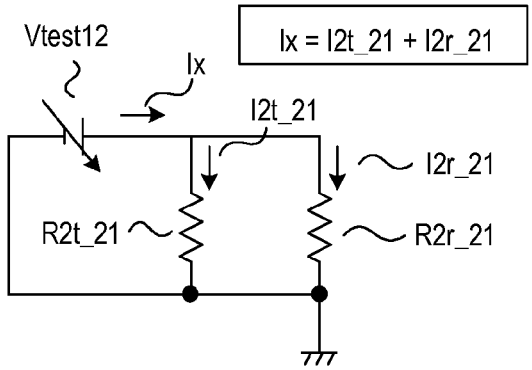

FIG. 4B is a circuit schematic diagram illustrating the load status when the voltage Vtest12 is applied in the condition where both the secondary transfer roller 10 and the ICL roller 39 are at the contact position. In FIG. 4B, a resistance R2*r*_21 denotes a combined resistance of the ICL roller 39, the intermediate transfer belt 9 and the secondary transfer opposing roller 5 where a cleaning current I2*r*_21 flows through. The current I2*r*_21 denotes a current flowing through the resistance R2*r*_21. The circuit in the condition where both the secondary transfer roller 10 and the ICL roller 39 are at the contact position can be a circuit in which the resistance R2*t*_21 where the secondary transfer current I2*t*_21 flows through and the resistance R2*r*_21 where the cleaning current I2*r*_21 flows through are connected in parallel. A current Ix is a combined current of the secondary transfer current I2*t*_21 and the cleaning current I2*r*_21, and the current detection circuit 81*h* detects the current value and outputs the current value to the CPU 85. The CPU 85 can calculate the current value of the cleaning current I2*r*_21 flowing through the resistance R2*r*_21 from a formula I2*r*_21=Ix−I2*t*_21 (different between current detection results). The CPU 85 can further calculate the resistance value of the resistance R2*r*_21 from a formula R2*r*_21=Vtest12/I2*r*_21.

Figure 4C:
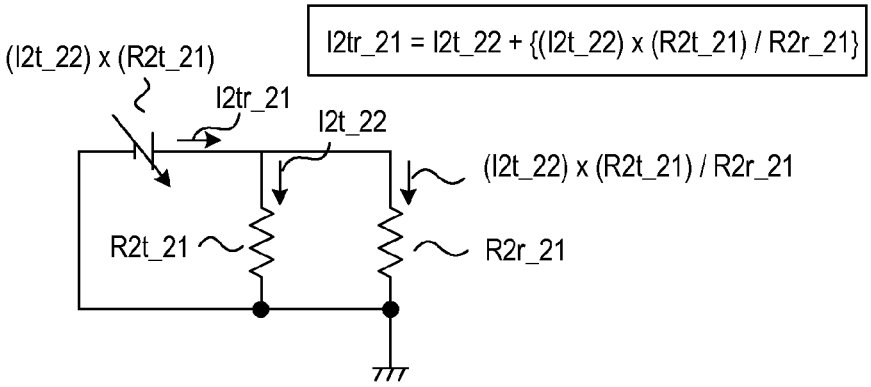

FIG. 4C is a circuit schematic diagram illustrating a load and an amount of current when a current I2*t*_22 with a predetermined current value (first predetermined current value) appropriate for the secondary transfer is applied to the secondary transfer roller 10, in the state of FIG. 4B. The applied secondary transfer voltage is calculated from a formula I2*t*_22×R2*t*_21, and the current value of the cleaning current is calculated from a formula I2*t*_22×R2*t*_21/R2*r*_21. As a result, a current value (first proper current value) of a combined constant current I2*tr*_21 of the secondary transfer current and the cleaning current is calculated from a formula I2*tr*_21=I2*t*_22+(I2*t*_22×R2*t*_21/R2*r*_21). R2*t*_21 and R2*r*_21 are resistance values that are already calculated.

The CPU 85 performs constant current control of the current I2*tr*_21 to supply an appropriate secondary transfer current in the secondary transfer. More specifically, the CPU 85 controls the current flowing to the secondary transfer member so that it is to be at constant current in the condition where the secondary transfer member and the ICL roller are at the contact position. The predetermined current value of the secondary transfer current I2*t*_22 is stored in advance in the ROM 87, and the CPU 85 reads the current value as necessary.

Figure 4D:
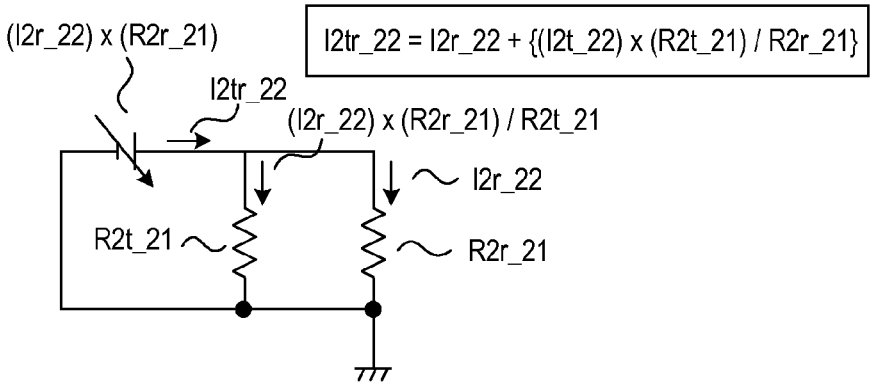

FIG. 4D is a circuit schematic diagram illustrating a load and an amount of current when a current I2*r*_22 with a predetermined current value (second predetermined current value) appropriate for cleaning is applied to the ICL roller 39, in the state of FIG. 4B. The applied secondary transfer voltage is calculated from a formula I2*r*_22×R2*r*_21, and the current value of the secondary transfer current is calculated from a formula I2*r*_22×R2*r*_21/R2*t*_21. As a result, a current value (second proper current value) of a combined constant current I2*tr*_22 of the secondary transfer current and the cleaning current is calculated from a formula I2*tr*_22=I2*r*_22+(I2*r*_22×R2*r*_21/R2*t*_21). The CPU 85 performs constant current control of the current I2*tr*_22 to supply an appropriate cleaning current when only cleaning is performed after the completion of the secondary transfer. More specifically, the CPU 85 controls the current flowing to the ICL roller so that it is to be a constant, while in the condition where the secondary transfer member and the ICL roller are at the contact position. The predetermined current value of the cleaning current I2*r*_22 is stored in advance in the ROM 87, and the CPU 85 reads the current value as necessary.

[Determination Procedure of Current Values for Secondary Transfer and for Cleaning and Image Formation Control Procedure]

Figures 5, 5A:
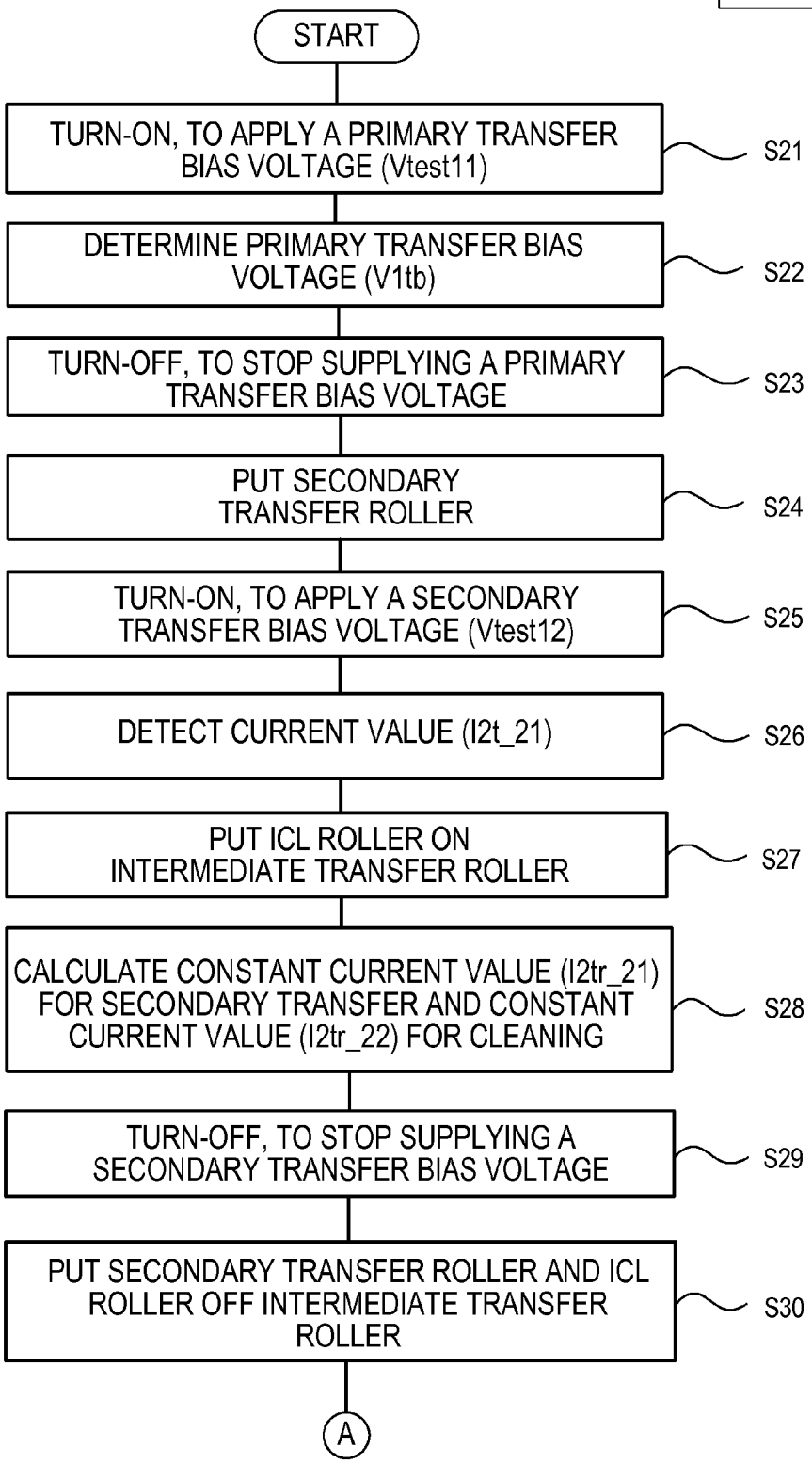
FIG. 5 which is comprised of FIGS. 5A and 5B is a flow chart illustrating a current value determination procedure and an image formation control procedure of the second embodiment.
Figure 5B:
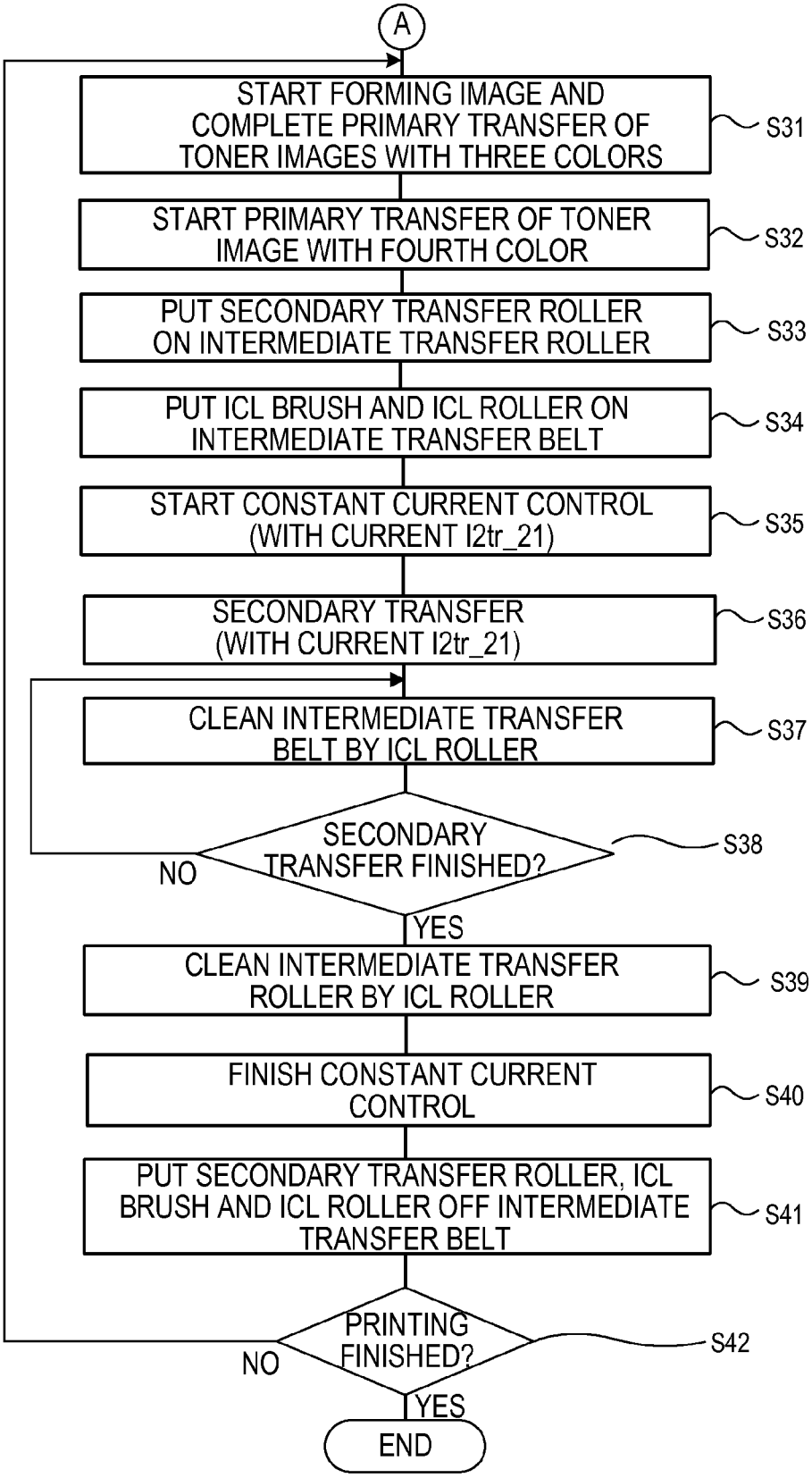

A control procedure from determination of a primary transfer voltage, a current value for secondary transfer and a current value for cleaning to finish of an image forming operation will be described with reference to FIGS. 5A and 5B. FIGS. 5A and 5B show a flow chart illustrating a determination procedure of the primary transfer voltage, the current value for secondary transfer and the current value for cleaning as well as a following image formation control procedure of the present embodiment. The CPU 85 executes the procedures based on a program stored in the ROM 87.

Before the image formation, the CPU 85 determines the voltage value V1*tb* necessary for the primary transfer as in the first embodiment (S21 to S23). The processes of S21 to S23 are the same as those of S1 to S3 in FIG. 3A of the first embodiment, and the description will not be repeated. The CPU 85 moves the secondary transfer roller 10 at the contact position (S24) and instructs the voltage power supply Vt2*r* to apply the voltage Vtest12 to the secondary transfer roller 10 (S25). As described, the current detection circuit 81*h* detects the current value of the secondary transfer current I2*t*_21 flowing through the secondary transfer roller 10, the intermediate transfer unit 9 and the secondary transfer opposing roller 5 and outputs the current value to the CPU 85. The CPU 85 stores the current value in the RAM 86 (S26). The CPU 85 moves the ICL roller 39 at the contact position (S27). While both the secondary transfer roller 10 and the ICL roller 39 are, at the contact position, the CPU 85 calculates the current value during the constant current control based on the current value of the secondary transfer current I2*t*_21 and the procedure described with reference to FIGS. 4B to 4D. The CPU 85 stores, in the RAM 86, the proper current values of the calculated constant current I2*tr*_21 during second transfer and the current I2*tr*_22 during cleaning (S28). The CPU 85 instructs the voltage power supply Vt2*r* to terminate outputting the voltage Vtest12 (S29). The CPU 85 moves the secondary transfer roller 10 and the ICL roller 39 at the non-contact position (S30).

The CPU 85 starts the image formation and finishes the primary transfer of the toner images of three colors (yellow, magenta and cyan) to the intermediate transfer unit 9 (S31). The primary transfer of the toner image of the fourth color (black) is started (S32). The CPU 85 moves the secondary transfer roller 10 at the contact position according to the timing when the leading edge of the toner image with the primarily transferred fourth color reaches the secondary transfer roller 10 (S33). The CPU 85 moves the ICL brush 50 and the ICL roller 39 at the contact position (S34). The CPU 85 reads the proper current value of the current I2*tr*_21 during secondary transfer calculated in S28 from the RAM 86 and instructs the voltage power supply Vt2*r* to supply the read current value to the secondary transfer roller 10 and the ICL roller 39 to start the constant current control (S35). Consequently, secondary transfer (S36) and cleaning (S37) are performed based on the constant current I2*tr*_21. The CPU 85 monitors whether the secondary transfer is finished and proceeds to a process of S39 if the CPU 85 determines that the secondary transfer is finished (S38).

In S39, the CPU 85 reads the proper current value of the current I2*tr*_22 during cleaning calculated in S28 from the RAM 86 and instructs the voltage power supply Vt2*r* to supply the read current value to the secondary transfer roller 10 and the ICL roller 39 to continue the constant current control. Consequently, cleaning is performed based on the constant current I2*tr*_22 (S39). When the cleaning of the intermediate transfer unit 9 is finished, the CPU 85 instructs the voltage power supply Vt2*r* to terminate supplying the current I2*tr*_22 to finish the constant current control (S40). The CPU 85 moves the secondary transfer roller 10, the ICL brush 50 and the ICL roller 39 at the non-contact position from the intermediate transfer unit 9 (S41). The CPU 85 determines whether printing of the recording material 2 is completed. The CPU 85 returns to the process of S31 if the printing is not completed and finishes the image formation if the printing is completed (S42).

As described, according to the present embodiment, the voltage power circuit and the current detection circuit can be shared for the primary transfer and for the ICL brush, and the voltage power supply and the current detection circuit can be shared for the secondary transfer and for the ICL roller. As a result, the cost and the circuit mounted area can be reduced. Particularly, the proper current values during secondary transfer and during cleaning can be calculated to stably transfer the toners based on the constant current control for making the current value provided to the toners constant. As a result, an image failure and a cleaning failure can be prevented, and the image quality and the accuracy of cleaning improve.

[Calculation of Current Value for Primary Transfer and Current Value for Cleaning]

Although the secondary transfer roller 10 and the ICL roller 39 are focused in the description of the present embodiment, the same control can also be performed for the primary transfer pad 40 and the ICL brush 50. As a result, the image quality and the cleaning accuracy can be improved. More specifically, the primary transfer pad can replace the secondary transfer roller, and the ICL brush can replace the ICL roller to calculate the current value for primary transfer and the current value for cleaning the ICL brush in the procedure described with reference to FIGS. 4A to 4D. In this regard, the voltage Vtest11 supplied from the voltage power supply Vt1*b* replaces the voltage Vtest12 in FIGS. 4A to 4D. The primary transfer current replaces the secondary transfer current I2*t*_21, and the cleaning current of the ICL brush replaces the cleaning current I2*r*_21 of the ICL roller. The resistance R2*t*_21 is replaced with the combined resistance of the primary transfer pad 40, the intermediate transfer unit 9 and the photosensitive drum 15 where the primary transfer current flows through. Similarly, the resistance R2*r*_21 is replaced with the combined resistance of the ICL brush 50, the intermediate transfer unit 9 and the secondary transfer opposing roller 5 where the cleaning current of the ICL brush flows through. As a result, the current Ix is replaced with the combined current of the primary transfer current I2*t*_21 and the cleaning current I2*r*_21 of the ICL brush. The current detection circuit 81*g* detects the current value and outputs the current value to the CPU 85. As a result of the replacements, FIG. 4A becomes a circuit schematic diagram illustrating a load status when the voltage Vtest11 is applied to the primary transfer pad 40 while the ICL brush 50 is at the non-contact position in which the ICL brush 50 is at the contact position.

FIG. 4B becomes a circuit schematic diagram illustrating a load status when the voltage Vtest11 is applied while the ICL brush 50 moves at the contact position. FIG. 4C becomes a circuit schematic diagram illustrating a load and an amount of current when the current I2*t*_22 with a predetermined current value appropriate for the primary transfer is applied to the primary transfer pad 40, in the state of FIG. 4B. Similarly, FIG. 4D becomes a circuit schematic diagram illustrating a load and an amount of current when the current I2*r*_22 with a predetermined current value appropriate for cleaning is applied to the ICL brush 50, in the state of FIG. 4B. The current value for primary transfer, the current value for cleaning the ICL brush and the resistance value of the combined resistance where the currents flow can be calculated based on the procedure described with reference to FIGS. 4A to 4D.

[Determination Procedure of Current Values for Primary Transfer and for Cleaning and Image Formation Control Procedure]

A control procedure from determination of the current values for primary transfer and for cleaning to finish of the image forming operation will be described based on a flow chart of FIGS. 5A and 5B illustrating a current value determination procedure for secondary transfer and for cleaning and an image formation control procedure. FIGS. 5A and 5B illustrate a processing procedure for the secondary transfer roller 10 and for the ICL roller 39. Therefore, the processing content will be replaced with the processing content for the primary transfer pad 40 and for the ICL brush 50 in the following description.

Although the processes of S21 to S23 of FIGS. 5A and 5B are processes of determining the voltage value V1*tb* necessary for the primary transfer, the process is not necessary to calculate the current value for primary transfer and the current value for cleaning, and the process will not be described. Although S24 is a process of moving the secondary transfer roller 10 at the contact position, because the primary transfer pad 40 does not have a movement mechanism, and the process is not necessary. The CPU 85 instructs the primary transfer pad 40 to apply the voltage Vtest11 (S25). As described, at this time, the current detection circuit 81*g* detects the current value of the primary transfer current I2*t*_21 flowing through the primary transfer pad 40, the intermediate transfer unit 9 and the photosensitive drum 15 and outputs the current value to the CPU 85. The CPU 85 stores the current value in the RAM 86 (S26). The CPU 85 moves the ICL brush 50 at the contact position (S27). In the condition where the ICL brush 50 is at the contact position, the CPU 85 calculates the current value during constant current control based on the current value of the primary transfer current I2*t*_21 and based on the procedure described with reference to FIGS. 4B to 4D. The CPU 85 stores, in the RAM 86, proper current values of the calculated constant current I2*tr*_21 during primary transfer and the current I2*tr*_22 during cleaning (S28). The CPU 85 instructs the voltage power supply Vt1*b* to terminate outputting the voltage Vtest11 (S29). The CPU 85 moves the ICL brush 50 at the contact position from the intermediate transfer unit 9 (S30).

The CPU 85 starts the image formation and completes the primary transfer of the toner images of three colors (yellow, magenta and cyan) to the intermediate transfer unit 9 (S31). During the first transfer, the CPU 85 reads the current value of the predetermined current I2*t*_22 appropriate for the primary transfer from the ROM 87 and instructs the voltage power supply Vt1*b* to supply the read current value to the primary transfer pad 40 to perform constant current control. The primary transfer of the toner image of the fourth color (black) is started (S32). The CPU 85 moves the secondary transfer roller 10 at the contact position according to the timing when the leading edge of the toner image on the intermediate transfer unit with the primarily transferred fourth color reaches the secondary transfer roller 10 (S33). The CPU 85 moves the ICL brush 50 and the ICL roller 39 at the contact position (S34). The CPU 85 reads the proper current value of the current I2*tr*_21 during primary transfer calculated in S28 from the RAM 86 and instructs the voltage power supply Vt1*b* to supply the read current value to the primary transfer pad 40 and the ICL brush 50 to continue the constant current control (S35). Consequently, primary transfer (S36) and cleaning (S37) are performed based on the constant current I2*tr*_21. The CPU 85 monitors whether the primary transfer is finished and proceeds to the process of S39 if the CPU 85 determines that the primary transfer is finished (S38).

In S39, the CPU 85 reads the proper current value of the current I2*tr*_22 during cleaning calculated in S28 from the RAM 86 and instructs the voltage power supply Vt1*b* to supply the read current value to the primary transfer pad 40 and the ICL brush 50 to continue the constant current control. Consequently, cleaning is performed based on the constant current I2*tr*_22 (S39). When the cleaning of the intermediate transfer unit is finished, the CPU 85 instructs the voltage power supply Vt1*b* to terminate supplying the current I2*tr*_22 to finish the constant current control (S40). The CPU 85 moves the secondary transfer roller 10, the ICL brush 50 and the ICL roller 39 at the non-contact position (S41). The CPU 85 determines whether printing of the recording material 2 is completed. The CPU 85 returns to the process of S31 if the printing is not completed and finishes the image formation if the printing is completed (S42).

As described, the control procedure of FIGS. 5A and 5B can be replaced to control the primary transfer pad 40 and the ICL brush 50 in the same way as the control of the secondary transfer roller 10 and the ICL roller 39. In this way, the toners can be stably transferred. As a result, an image failure and a cleaning failure can be prevented, and the image quality and the accuracy of cleaning are improved.

Third Embodiment

In the control of the secondary transfer and the cleaning, the constant voltage control is more suitable than the constant current control depending on the circumstances of the image forming apparatus, such as when the resistance value of the pressure roller 27 in the fixation unit 25 of FIG. 1 is small. In FIG. 1, if the resistance value of the pressure roller 27 is small when the recording material 2 is placed between the secondary transfer nip section and the fixation nip section, the resistance value of the recording material 2 is reduced when the secondary transfer voltage is applied in a hot and humid environment. As a result, the current transmits from the secondary transfer roller 10 to the recording material 2 and the pressure roller 27, and the current (leakage current) may flow through a section that is not in the regular route (route through i) the secondary transfer roller 10, ii) the recording material 2, iii) the intermediate transfer unit 9, iv) the secondary transfer opposing roller 5 and v) the GND). In this case, if the CPU 85 falsely detects a combined value of the current value flowing through the regular route and the leakage current as the current value during secondary transfer to perform the constant current control, the appropriate secondary transfer current is not supplied to the regular route, and the image quality is degraded. A similar phenomenon occurs when the resistance value of a component, such as a transport guide, that is in contact with the recording material 2 is reduced, and the secondary transfer voltage is applied in a hot and humid environment. Therefore, a humidity sensor arranged in the image forming apparatus can detect the humidity when the apparatus is in use, and if the humidity is high, the constant current control can be switched to the constant voltage control to perform the image forming operation.

The present embodiment focuses on the secondary transfer that significantly affects the image quality, and optimal constant voltage control related to the secondary transfer roller 10 and the ICL roller 39 will be described. In the present embodiment, the constant voltage control optimal for the secondary transfer is performed when the secondary transfer and the cleaning are performed at the same time, and the constant voltage control optimal for the cleaning is performed when the secondary transfer is finished and only the cleaning is performed. Hereinafter, the following description is based on the case in which the ICL roller 39 is always at the contact position at the start of the secondary transfer.

[Calculation of Voltage Value for Secondary Transfer and Voltage Value for Cleaning]

The circuit configuration of the voltage power supply and the current detection circuit illustrated in FIG. 2 of the first embodiment are used in the present embodiment. A calculation procedure of the voltage value for secondary transfer and the voltage value for cleaning set in the constant voltage control will be described with reference to FIGS. 4A and 4B of the second embodiment. The voltage values necessary for the secondary transfer and for the cleaning are calculated before the image forming operation as in the first and second embodiments.

In FIG. 4A, the current detection circuit 81*h* detects the current value of the secondary transfer current I2*t*_21 flowing through the combined resistance R2*t*_21 of the secondary transfer roller 10, the intermediate transfer unit 9 and the secondary transfer opposing roller 5 and inputs the current value to the CPU 85. The CPU 85 can calculate the resistance value of the combined resistance R2*t*_21 from a formula R2*t*_21=Vtest12/I2*t*_21. As in the second embodiment, the CPU 85 reads the appropriate predetermined current value of the secondary transfer current I2*t*_22 from the ROM 87 and calculates a constant voltage value V2*t*_21 (first proper voltage value) necessary for the secondary transfer from a formula V2*t*_21=Vtest12×I2*t*_22/I2*t*_21. The CPU 85 performs the constant voltage control to set the applied voltage value for the secondary transfer roller 10 to V2*t*_21 during the second transfer.

In FIG. 4B, the combined current when the voltage Vtest12 is applied is Ix. The current detection circuit 81*h* detects the current value of the current Ix and inputs the current value to the CPU 85. The CPU 85 can calculate the current of the cleaning current I2*r*_21 flowing through the combined resistance R2*r*_21 of the ICL roller 39, the intermediate transfer unit 9 and the secondary transfer opposing roller 5 from the formula I2*r*_21=Ix−I2*t*_21 (difference between the current detection results). The CPU 85 can calculate the resistance value of the combined resistance R2*r*_21 from the formula R2*r*_21=Vtest12/I2*r*_21. As in the second embodiment, the CPU 85 reads the appropriate predetermined current value of the cleaning current I2*r*_22 from the ROM 87 and calculates a constant voltage V2*r*_21 (second proper voltage value) necessary for cleaning from a formula V2*r*_21=Vtest12×12*r*_22/I2*r*_21. The CPU 85 performs the constant voltage control to set the applied voltage value for the ICL roller 39 to V2*r*_21 when only the cleaning is performed after the completion of the secondary transfer.

[Determination Procedure of Voltage Value for Secondary Transfer and Voltage Value for Cleaning and Image Formation Control Procedure]

A control procedure from determination of voltages to completion of an image forming operation in the present embodiment is the same as in FIGS. 5A and 5B of the second embodiment, except for calculation of the constant voltage for secondary transfer, calculation of the constant voltage for cleaning, and a process of switching the constant current control to the constant voltage control. More specifically, the process of S28 of FIG. 5A includes the calculation of the constant voltage value for secondary transfer (V2*t*_21) and the calculation of the constant voltage value for cleaning (V2*r*_21) in the present embodiment. Similarly, the process of S35 includes start of the constant voltage control (voltage value V2*t*_21). S36 includes the secondary transfer (voltage value V2*t*_21), and S37 includes the cleaning by the ICL roller (voltage value V2*t*_21). The process of S39 includes the cleaning by the ICL roller (voltage value V2*r*_21), and S40 includes the finish of the constant voltage control. The calculation procedure of the constant voltage is described above, and the detailed description based on the flow chart of FIGS. 5A and 5B will not be repeated.

As described, according to the present embodiment, the voltage power circuit and the current detection circuit can be shared for the primary transfer and for the ICL brush, and the voltage power supply and the current detection circuit can be shared for the secondary transfer and for the ICL roller to reduce the cost and the circuit mounted area. The calculation of the proper voltage values during secondary transfer and during cleaning and the constant voltage control can prevent the degradation in the image quality even if a leakage current flows through an unintended route other than the secondary transfer roller and the ICL roller due to a hot and humid environment.

Although the secondary transfer roller 10 and the ICL roller 39 are focused in the description of the present embodiment, similar control can be performed in relation to the primary transfer pad 40 and the ICL brush 50. As a result, the image quality and the cleaning accuracy can be improved. More specifically, as in the second embodiment, the primary transfer pad 40 and the ICL brush 50 can replace the secondary transfer roller 10 and the ICL roller 39 in the procedure described with reference to FIGS. 4A and 4B to calculate the voltage values for primary transfer and for cleaning. The control procedure from the determination of the voltage to the finish of the image forming operation is the same as in the description with reference to FIGS. 5A and 5B of the second embodiment, except that the calculation of the constant current values of the primary transfer pad 40 and the ICL brush 50 described in the second embodiment is switched to the calculation of the constant voltage values and that the constant current control is switched to the constant voltage control. More specifically, the primary transfer pad 40 and the ICL brush 50 can replace the secondary transfer roller 10 and the ICL roller 39 in the description of the control procedure to apply the control procedure in the constant voltage control to the primary transfer pad 40 and the ICL brush 50. As a result, the degradation in the image quality can be prevented even if a leakage current flows through an unintended route other than the primary transfer pad and the ICL brush due to a hot and humid environment.

Fourth Embodiment

Figure 6:
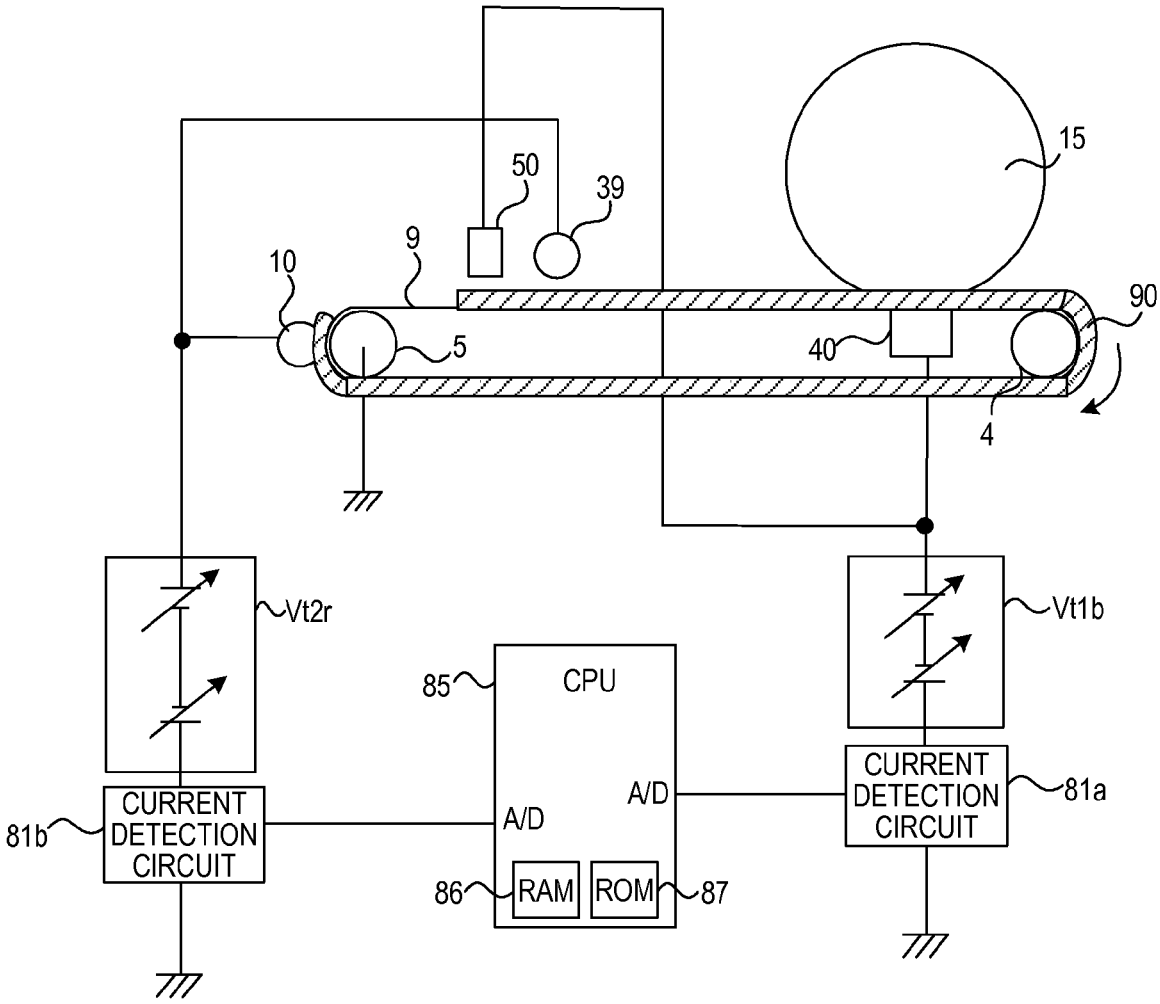
FIG. 6 is a diagram illustrating a positional relationship between an image area on the intermediate transfer unit and a cleaning mechanism of the fourth embodiment.

In the second and third embodiments, the constant current control and the constant voltage control are described on the assumption that the ICL roller 39 is always at the contact position at the start of the secondary transfer. If the printer is downsized and the peripheral length of the intermediate transfer unit 9 is reduced, there is a case in which the ICL brush 50 and the ICL roller 39 cannot move at the contact position at the start of the secondary transfer. FIG. 6 is a diagram illustrating a positional relationship between an image area 90 (shaded section) on the intermediate transfer unit 9 and the cleaning mechanism when the peripheral length of the belt is short. As illustrated in FIG. 6, the image area 90 that will receive the fourth color exists at a position where the cleaning mechanism contacts the intermediate transfer unit 9 when the leading edge of the toner image on the intermediate transfer unit 9 with the superposed fourth color reaches the start position of the secondary transfer. Therefore, the cleaning mechanism cannot be moved at the contact position. As a result, the ICL brush 50 and the ICL roller 39 are moved at the contact position after the image area 90 has passed through the ICL brush 50 and the ICL roller 39.

Consequently, the present embodiment focuses on the secondary transfer that significantly affects the image quality as in the second and third embodiments, and optimal constant current control related to the secondary transfer roller 10 and the ICL roller 39 when the ICL roller 39 cannot move at the contact position at the start of the secondary transfer will be described. In the present embodiment, the constant current control optimal for the secondary transfer is performed when only the secondary transfer is performed or when the secondary transfer and the cleaning are performed at the same time. The constant current control optimal for the cleaning is performed when the secondary transfer is finished and only the cleaning is performed. A control flow from the start of the secondary transfer to the finish of the cleaning in the present embodiment proceeds in the order of i) contact of the secondary transfer roller 10, ii) start of the secondary transfer, iii) contact of ICL roller 39 during secondary transfer, iv) execution of secondary transfer and cleaning, v) finish of secondary transfer, vi) execution of only cleaning and vii) finish of cleaning.

The same voltage configuration as in the first embodiment (FIG. 2) will be used in the present embodiment.

[Determination Procedure of Current Values for Secondary Transfer and for Cleaning and Image Formation Control Procedure]

Figures 1, 7A:
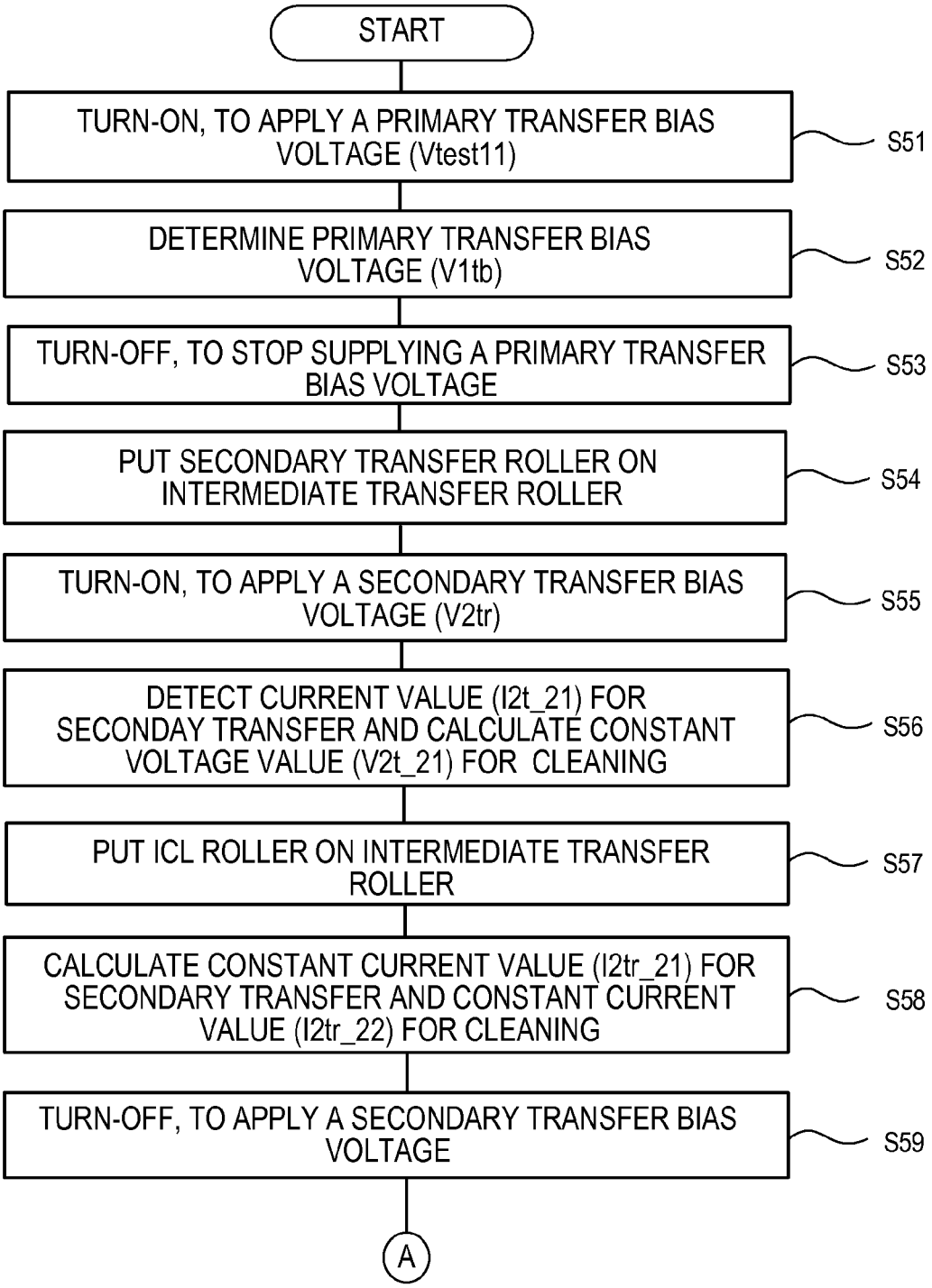
FIG. 7A which is comprised of FIGS. 7A-1, 7A-2 and 7A-3 is a flow chart of a current value determination procedure and an image formation control procedure of the fourth embodiment.
Figures 2, 7A:
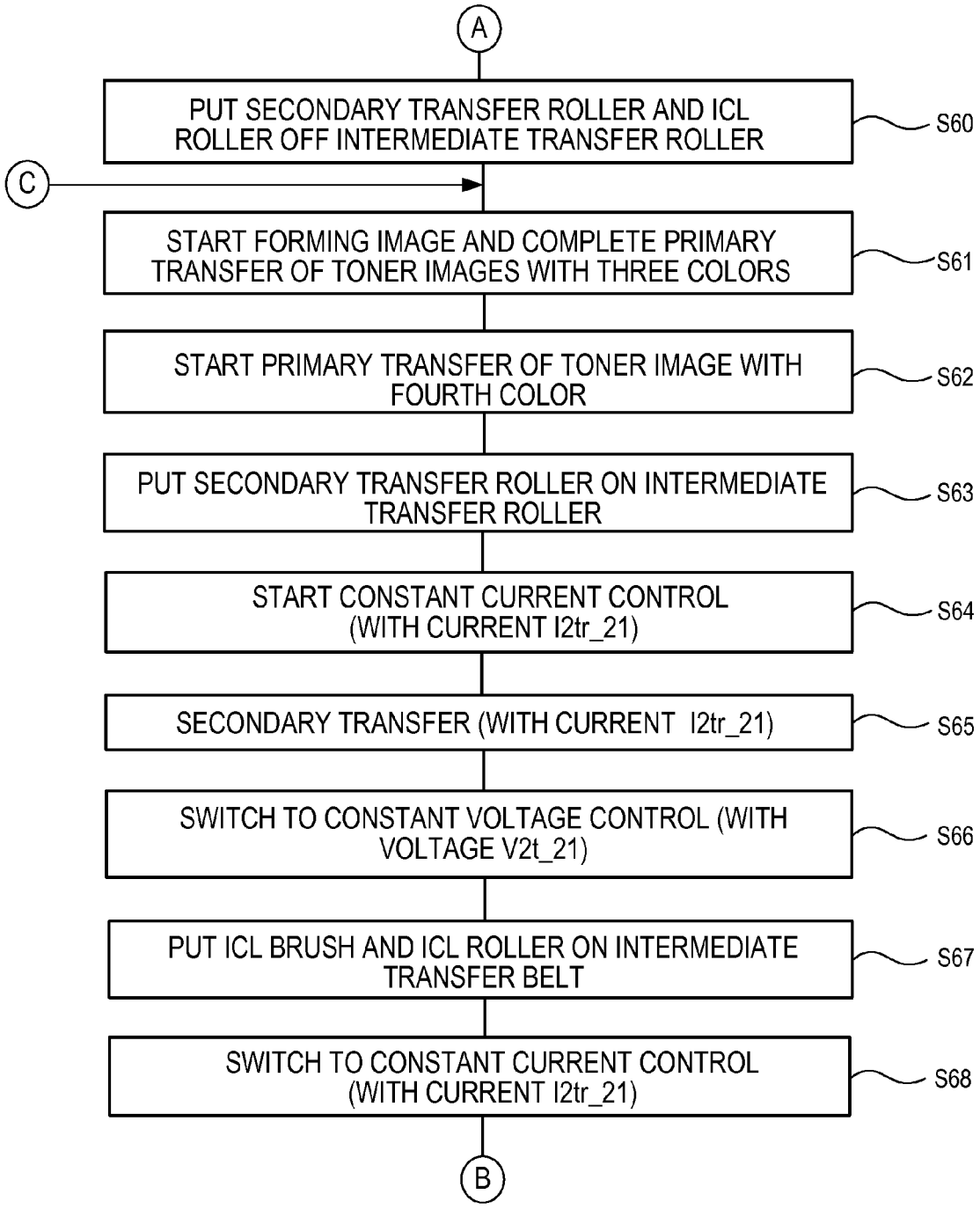
Figures 3, 7A:
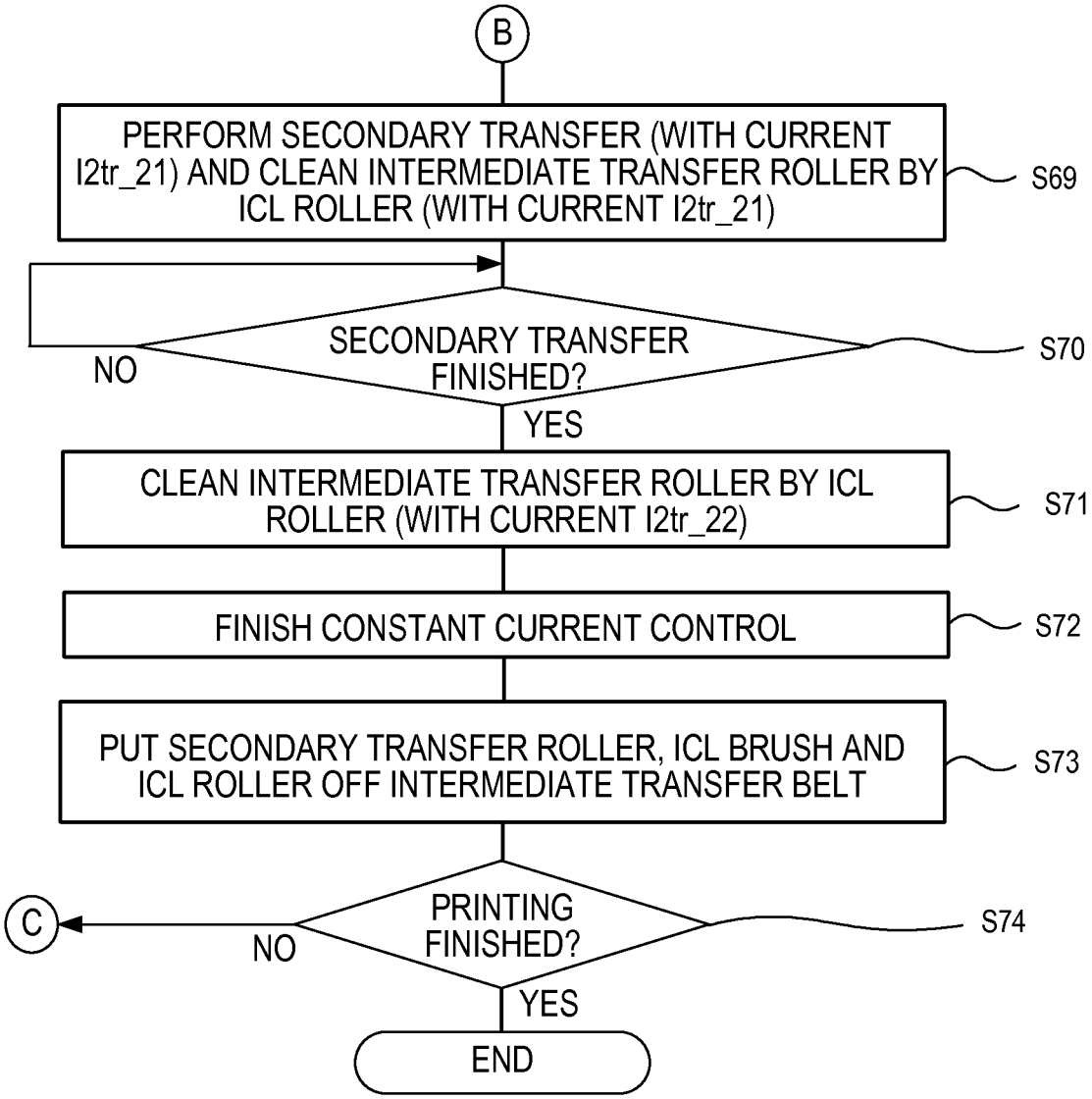
Figure 7B:
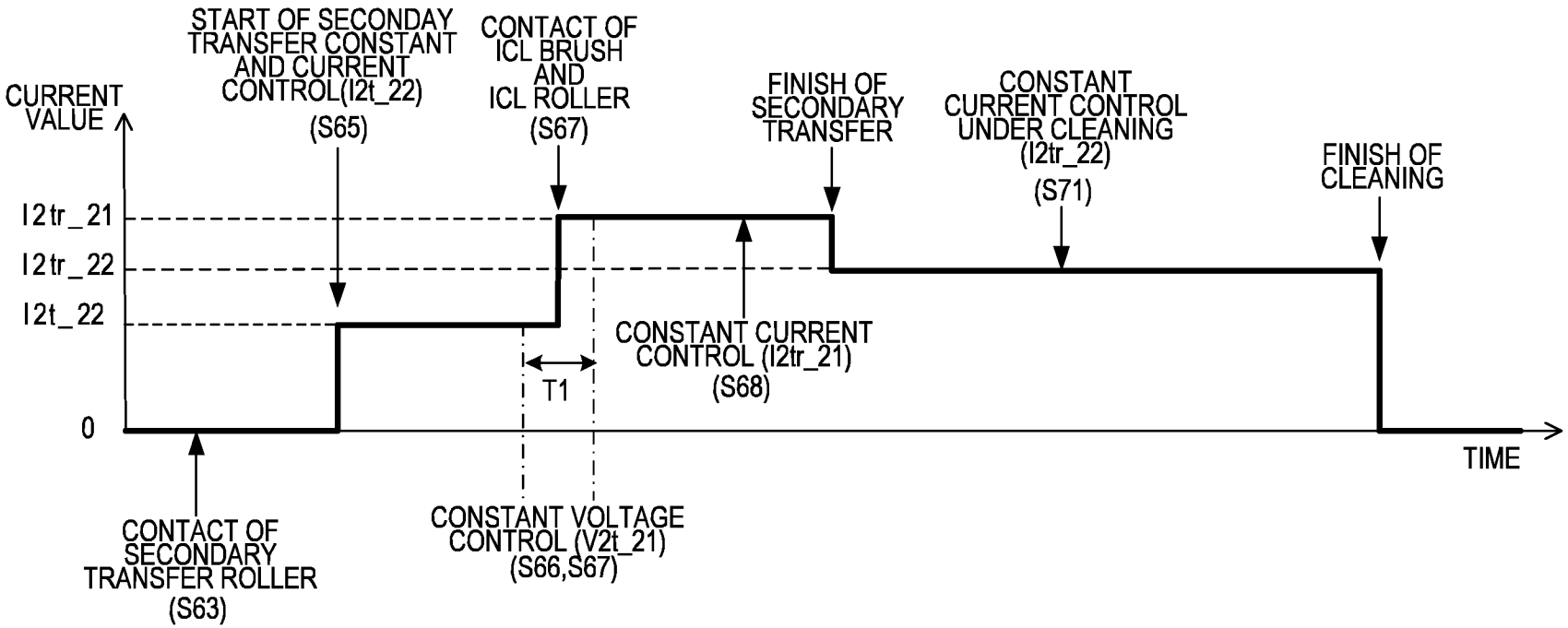
FIG. 7B illustrates a sequence of control from contact of the secondary transfer roller to finish of cleaning.

A control procedure from determination of a primary transfer voltage and current values for secondary transfer and for cleaning to finish of an image forming operation will be described with reference to FIGS. 7A-1, 7A-2, 7A-3 and 7B. FIGS. 7A-1, 7A-2 and 7A-3 show a flow chart illustrating a determination procedure of a primary transfer voltage, a current value for secondary transfer and a current value for cleaning and a following image formation control procedure of the present embodiment. The CPU 85 executes the procedure based on a program stored in the ROM 87. FIG. 7B is a chart illustrating in chronological order a flow of control from contact of the secondary transfer roller 10 to finish of cleaning and a change in a set current value of constant current control based on the control procedure of FIGS. 7A-1, 7A-2 and 7A-3. The vertical axis denotes the current value, and the horizontal axis denotes elapsed time.

In FIGS. 7A-1, 7A-2 and 7A-3, a control operation of determining the primary transfer voltage of S51 to S53 is the same as S21 to S23 illustrated in FIGS. 5A and 5B of the second embodiment, and the description will not be repeated. The CPU 85 moves the secondary transfer roller 10 at the contact position (S54) and instructs the voltage power supply Vt2*r* to apply the voltage Vtest12 to the secondary transfer roller 10 (S55). The current detection circuit 81*h* detects the current value of the secondary transfer current I2*t*_21 flowing through the secondary transfer roller 10, the intermediate transfer unit 9 and the secondary transfer opposing roller 5 and outputs the current value to the CPU 85, and the CPU 85 stores the current value in the RAM 86 (S56).

The CPU 85 reads the predetermined current value appropriate for the secondary transfer current I2*t*_22 from the ROM 87 to calculate the constant voltage value V2*t*_21 necessary for the secondary transfer from the formula V2*t*_21=Vtest12×I2*t*_22/I2*t*_21 and stores the value in the RAM 86 (S56). The CPU 85 moves the ICL roller 39 at the contact position (S57). As in the second embodiment, the CPU 85 calculates the proper current value I2*tr*_21 in the secondary transfer and the proper current value I2*tr*_22 in the cleaning and stores the values in the RAM 86 (S58). The CPU 85 instructs the voltage power supply Vt2*r* to terminate outputting the secondary transfer voltage (S59) and move the secondary transfer roller 10 and the ICL roller 39 at the non-contact position (S60).

The CPU 85 starts the image formation and completes the primary transfer of the toner images of three colors (yellow, magenta and cyan) to the intermediate transfer unit 9 (S61). The primary transfer of the toner image of the fourth color (black) is started (S62). The CPU 85 moves the secondary transfer roller 10 at the contact position according to the timing when the leading edge of the toner image on the intermediate transfer unit with the primarily transferred fourth color reaches the secondary transfer roller 10 (S63). The CPU 85 reads the proper current value of the current I2*t*_22 during secondary transfer from the ROM 87 and instructs the voltage power supply Vt2*r* to supply the read current value to the secondary transfer roller 10 to start the constant current control (S64). As a result, the secondary transfer based on the constant current I2*t*_22 is performed (S65).

The CPU 85 moves the ICL roller 39 at the contact position after the trailing edge of the image area 90 on the intermediate transfer unit 9 has passed through the contact region with the ICL roller 39. However, a rapid change in the load occurs when the ICL roller 39 moves from the non-contact position to the contact position, and the current detection is disordered. The continuation of the constant current control is difficult. Therefore, the constant current control is switched to the constant voltage control during a certain time (T1 time) from just before the ICL roller 39 reaches the contact position to after the ICL roller 39 reaches the contact position. In this regard, the CPU 85 reads the constant voltage value V2*t*_21 necessary for the secondary transfer calculated in the process of S56 from the RAM 86 and instructs the voltage power supply Vt2*r* to apply the read voltage value to the secondary transfer roller 10 to switch the control to the constant voltage control (S66). The CPU 85 activates the timer to monitor the lapse of the T1 time and moves the ICL brush 50 and the ICL roller 39 at the contact portion (S67). The timing of the contact of the ICL roller 39 and the time of the constant voltage control can be stored in advance in the ROM 87 based on the primary transfer timing, the process speed and the time until the load variation becomes stable.

The CPU 85 determines whether the T1 time has passed based on the timer and switches the constant voltage control to the constant current control if the CPU 85 determines that the T1 time has passed (S68). The CPU 85 reads the constant current value I2*tr*_21 for secondary transfer calculated in the process of S58 from the RAM 86 and instructs the voltage power supply Vt2*r* to supply the read current value to the secondary transfer roller 10 and the ICL roller 39 to switch the control to the constant current control (S68). As a result, the secondary transfer and the cleaning are performed based on the constant current I2*tr*_21 (S69). The CPU 85 monitors whether the secondary transfer is finished and proceeds to a process of S71 if the CPU 85 determines that the secondary transfer is finished (S70). In S71, the CPU 85 reads the proper current value of the current I2*tr*_22 during cleaning from the RAM 86 and instructs the voltage power supply Vt2*r* to supply the read current value to the secondary transfer roller 10 and the ICL roller 39 to continue the constant current control. As a result, the cleaning is performed based on the constant current I2*tr*_22 (S71). When the cleaning of the intermediate transfer unit 9 is completed, the CPU 85 instructs the voltage power supply Vt2*r* to terminate supplying the current I2*tr*_22 and finishes the constant current control (S72). The CPU 85 moves the secondary transfer roller 10, the ICL brush 50 and the ICL roller 39 at the non-contact position from the intermediate transfer unit 9 (S73). The CPU 85 determines whether printing of the recording material 2 is completed. The CPU 85 returns to the process of S61 if the printing is not completed and finishes the image formation if the printing is completed (S74).

As described, according to the present embodiment, the voltage power circuit and the current detection circuit can be shared for the primary transfer and for the ICL brush, and the voltage power supply and the current detection circuit can be shared for the secondary transfer and for the ICL roller to reduce the cost and the circuit mounted area. The calculation of the proper current values during secondary transfer and during cleaning and the combination of the constant voltage control and the constant current control can prevent the image failure and the cleaning failure even if the peripheral length of the intermediate transfer unit 9 is short and the ICL brush 50 and the ICL roller 39 moves at the contact position after the start of the secondary transfer. In the secondary transfer and cleaning control, the toners can be stably transferred by the constant current control that makes the current values provided to the toners constant. As a result, the image failure and the cleaning failure can be prevented, and the image quality and the accuracy of cleaning improve. However, the current detection is disordered by a rapid change in the load when the ICL roller 39 contacts the intermediate transfer unit 9, and the continuation of the constant current control is difficult. Therefore, the control is switched to the constant voltage control from just before the contact of the ICL roller 39 to a certain time after the contact to prevent the image failure and the cleaning failure in the present embodiment.

[Determination Procedure of Current Values for Primary Transfer and for Cleaning and Image Formation Control Procedure]

Although the secondary transfer roller 10 and the ICL roller 39 are focused in the description of the present embodiment, similar control can also be performed in relation to the primary transfer pad 40 and the ICL brush 50. As a result, the image quality and the cleaning accuracy can be improved. More specifically, for the primary transfer pad 40 and the ICL brush 50, the control procedure illustrated in FIGS. 7A-1, 7A-2 and 7A-3 can be replaced with a control procedure for the primary transfer and for the ICL brush as in the second and third embodiments. In this way, the primary transfer pad 40 and the ICL brush 50 can be controlled.

In FIGS. 7A-1, 7A-2 and 7A-3, the processes of S51 to S60 is the same as the processes of S21 to S30 of FIG. 5A of the second embodiment. The process in the case of the primary transfer pad 40 and the ICL brush 50 is described in detail in the second embodiment, and the description will not be repeated. In the process of S56, the constant voltage value (V2*t*_21) for primary transfer is calculated by the following process. In S56, the CPU 85 reads the predetermined current value appropriate for the primary transfer current I2*t*_22 from the ROM 87 to calculate the constant voltage value V2*t*_21 necessary for the primary transfer from a formula V2*t*_21=Vtest11×I2*t*_22/I2*t*_21 and stores the value in the RAM 86.

The CPU 85 starts the image formation. The processes of S61 to S63 are the same as those of S31 to S33 of FIG. 5B, and the description will not be repeated. The CPU 85 continues the constant current control for the primary transfer pad 40 (S64). S65 is a process for the secondary transfer roller 10, and the process is not necessary in this case. A rapid change in the load occurs when the ICL brush 50 is at the contact position, and the current detection is disordered. The continuation of the constant current control is difficult. Therefore, the CPU 85 switches the constant current control to the constant voltage control from just before the contact of the ICL brush 50 to a certain time (T1 time) after the contact. In this regard, the CPU 85 reads the constant voltage value V2*t*_21 necessary for the primary transfer calculated in the process of S56 from the RAM 86 and instructs the voltage power supply Vt1*b* to apply the read voltage value to the primary transfer pad 40 to switch the control to the constant voltage control (S66). The CPU 85 activates the timer to monitor the lapse of the T1 time and moves the ICL brush 50 and the ICL roller 39 at the contact portion (S67).

If the CPU 85 determines that the T1 time has passed based on the timer, the CPU 85 switches the constant voltage control to the constant current control (S68). The CPU 85 reads the constant current value I2*tr*_21 for primary transfer calculated in the process of S58 from the RAM 86 and instructs the voltage power supply Vt1*b* to supply the read current value to the primary transfer pad 40 and the ICL brush 50 to switch the control to the constant current control (S68). As a result, the primary transfer and the cleaning are performed based on the constant current I2*tr*_21 (S69). The CPU 85 monitors whether the primary transfer is finished and proceeds to the process of S71 if the CPU 85 determines that the primary transfer is finished (S70). In S71, the CPU 85 reads the proper current value of the current I2*tr*_22 during cleaning from the RAM 86 and instructs the voltage power supply Vt1*b* to supply the read current value to the primary transfer pad 40 and the ICL brush 50 to continue the constant current control. Consequently, cleaning is performed based on the constant current I2*tr*_22 (S71). When the cleaning of the intermediate transfer unit is completed, the CPU 85 instructs the voltage power supply Vt1*b* to terminate supplying the current I2*tr*_22 and finishes the constant current control (S72). The CPU 85 moves the secondary transfer roller 10, the ICL brush 50 and the ICL roller 39 at the non-contact position from the intermediate transfer unit 9 (S73). The CPU 85 determines whether printing of the recording material 2 is completed. The CPU 85 returns to the process of S61 if the printing is not completed and finishes the image formation if the printing is completed (S74).

As described, the same control as for the secondary transfer roller 10 and the ICL roller 39 can be performed for the primary transfer pad 40 and the ICL brush 50 by replacing the control procedure of FIGS. 7A-1, 7A-2, 7A-3 and 7B. As a result, the image failure and the cleaning failure can be prevented even if the peripheral length of the intermediate transfer unit 9 is short and the ICL brush 50 and the ICL roller 39 moves at the contact region after the start of the secondary transfer. Particularly, the current detection is disordered by a rapid change in the load when the ICL brush 50 contacts the intermediate transfer unit 9, and the continuation of the constant current control is difficult. Therefore, the image failure and the cleaning failure are prevented by switching the control to the constant voltage control during a certain time from just before the ICL brush 50 contacts the intermediate transfer unit 9 to after the ICL brush 50 contacts the intermediate transfer unit 9.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-120324, filed May 30, 2011, which is hereby incorporated by reference herein in its entirety.

What is claimed is:

1. An image forming apparatus comprising:

an image bearing member that bears a toner image;

an image forming unit that forms a toner image on the image bearing member;

an intermediate transfer unit that is movable;

a primary transfer member that primarily transfers the toner image to the intermediate transfer unit;

a cleaning member that cleans toner remaining on the intermediate transfer unit, the cleaning member being movable between a contact position in which the cleaning member contacts the intermediate transfer unit and a non-contact position in which the cleaning member does not contact the intermediate transfer unit;

a voltage application unit that applies a voltage to the primary transfer member and the cleaning member;

a control unit; and a current detection unit that detects a current flowing through the voltage application unit, wherein the control unit moves the cleaning member to the non-contact position, determines a transfer voltage based on a current value detected by the current detection unit when a predetermined voltage is applied from the voltage application unit to the primary transfer member before image formation and in a condition where the cleaning member is at the non-contact position, and wherein the control unit applies the transfer voltage to the primary transfer member during the image formation.

2. An image forming apparatus according to claim 1, comprising;

another cleaning member that cleans residual toner remaining on the intermediate transfer unit, the another cleaning member being movable between a contact position in which the another cleaning member contacts the intermediate transfer unit and a non-contact position in which the another cleaning member does not contact the intermediate transfer unit;

a secondary transfer member that secondarily transfers a toner image from the intermediate transfer unit to the recording material, the secondary transfer member being movable between a contact position in which the secondary transfer member contacts the intermediate transfer unit and a non-contact position in which the secondary transfer member does not contact the intermediate transfer unit;

another voltage application unit that applies a voltage to the secondary transfer member and the another cleaning member; and another current detection unit that detects a current flowing to the another voltage application unit.

3. An image forming apparatus according to claim 1 wherein the primary transfer member includes a conductive layer that contacts an internal surface of the intermediate transfer unit with a surface of the primary transfer member.

4. An image forming apparatus according to claim 3, wherein the cleaning member is a brush member that has conductive fibers for a conductive brush and rubs and charges the residual toner on the intermediate transfer belt.

5. An image forming apparatus according to claim 4, wherein the conductive layer of the primary transfer member and the conductive fibers for a conductive brush have the same characteristic tendencies of resistance value variations caused by environmental changes.

6. An image forming apparatus comprising:

an image bearing member that bears a toner image;

an image forming unit that forms a toner image on the image bearing member;

an intermediate transfer unit to which the toner image is primarily transferred from the image bearing member;

a secondary transfer member that secondarily transfers the toner image from the intermediate transfer unit to a recording material, the secondary transfer member being movable between a contact position in which the secondary transfer member contacts the intermediate transfer unit and a non-contact position in which the secondary transfer member does not contact the intermediate transfer unit;

a cleaning member that cleans a toner remaining on the intermediate transfer unit, the cleaning member being movable between a contact position in which the cleaning member contacts the intermediate transfer unit and a non-contact position in which the cleaning member does not contact the intermediate transfer unit;

a voltage application unit that applies a voltage to the secondary transfer member and the cleaning member;

a current detection unit that detects a current flowing through the voltage application unit; and a control unit, wherein the control unit applies a secondary transfer voltage from the voltage application unit when an image is secondarily transferred, wherein the secondary transfer voltage is determined based on a first current value detected by the current detection unit when a predetermined voltage is applied from the voltage application unit in a condition where the secondary transfer member is at a contact position and the cleaning member is at the non-contact position.

7. An image forming apparatus according to claim 6, wherein the voltage application unit applies a voltage so that a current flowing to the secondary transfer member and the cleaning member is constant.

8. An image forming apparatus according to claim 6, wherein the cleaning member moves to the contact position before the secondary transfer member starts secondarily transferring an image.

9. An image forming apparatus according to claim 6, wherein the control unit moves the cleaning member to the contact position after the current detection unit detects the first current value, wherein in a condition where both the secondary transfer member and the cleaning member are at the contact position, the voltage application unit applies the predetermined voltage and the current detection unit detects the second current value.

10. An image forming apparatus according to claim 9, wherein the control unit applies a cleaning voltage from the voltage application unit in a case where the cleaning member cleans the intermediate transfer unit after the secondary transfer is finished, and wherein the cleaning voltage is determined by the first and second current values.

11. An image forming apparatus according to claim 6, wherein the secondary transfer member includes a secondary transfer roller having a conductive layer.

12. An image forming apparatus according to claim 11, wherein the cleaning member includes a charge roller having a conductive layer and charges toner remaining on the intermediate transfer member.

13. An image forming apparatus according to claim 12, wherein the conductive layer of the secondary transfer roller and the conductive layer of the charge roller have the same characteristic tendencies of resistance value variations caused by environmental changes.

* * * * *